US007272344B2

(12) United States Patent
Miura et al.

(10) Patent No.: US 7,272,344 B2
(45) Date of Patent: Sep. 18, 2007

(54) IMAGE FORMING METHOD CAPABLE OF MAINTAINING SUSTAINED STABLE CLEANING PERFORMANCE WITHOUT CAUSING AN IMAGE SMEARING PHENOMENON EVEN WITH A HIGH STRENGTH AND HIGH ABRASION IMAGE BEARING MEMBER

(75) Inventors: Masaharu Miura, Susono (JP); Hiroaki Kawakami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 11/128,365

(22) Filed: May 13, 2005

(65) Prior Publication Data

US 2005/0254856 A1 Nov. 17, 2005

(30) Foreign Application Priority Data

May 14, 2004 (JP) ..... 2004-144334
Mar. 11, 2005 (JP) ..... 2005-069543

(51) Int. Cl.
*G03G 15/00* (2006.01)
*G03G 15/02* (2006.01)
*G03G 21/00* (2006.01)

(52) U.S. Cl. ..... 399/159; 399/176; 399/349; 399/350

(58) Field of Classification Search ..... 399/159, 399/174, 176, 346, 347, 349, 350, 353; 430/56
See application file for complete search history.

(56) References Cited

U.S. PATENT DOCUMENTS 6,014,540 A * 1/2000 Sako et al. ..... 399/349 X
6,215,971 B1 * 4/2001 Sakoh et al. ..... 399/159
6,311,037 B1 * 10/2001 Hisakuni et al. ..... 399/350
6,497,984 B2 * 12/2002 Itami et al. ..... 399/350 X (Continued)

FOREIGN PATENT DOCUMENTS

EP 1 302 819 A2 4/2003

(Continued)

OTHER PUBLICATIONS

Patent Abstracts of Japan, Publication No. 2002364633A, Dec. 18, 2002.

*Primary Examiner*—Sandra L. Brase
(74) *Attorney, Agent, or Firm*—Fitzpatrick, Cella, Harper & Scinto

(57) ABSTRACT

The invention is to provide an image forming method of a long service life, a high image quality and a low running cost, capable of maintaining a stable cleaning performance over a prolonged period without causing an image deletion phenomenon, even with a image bearing member such as a photosensitive member, of a high durability (high strength and high abrasion resistance). The invention provides an image forming method characterized in that the image bearing member has a universal surface hardness HU of 150 to 220 N/mm$^2$ and an elastic deformation ratio We of 40 to 65%, and, for a crossing angle θ (°) between a rotary axis of the contact charging roller and a rotary axis of the image bearing member, for a ratio A (weight %) of the transfer residual toner and the abrasive particles and for a contact pressure B (g/cm) of the cleaning blade, HU, We, A, B and θ satisfy the following relations (I), (II) and (III):

$$(1/6000)\times HU\times We \leqq A\times B \quad \text{(I)}$$

$$A/B \leqq \theta \quad \text{(II)}$$

$$10 \leqq B \leqq 50. \quad \text{(III)}$$

10 Claims, 6 Drawing Sheets

U.S. PATENT DOCUMENTS

| | | | | |
|---|---|---|---|---|
| 6,600,886 | B2 * | 7/2003 | Tsukida et al. | 399/174 X |
| 2003/0035668 | A1 | 2/2003 | Endo et al. | 399/350 |
| 2003/0194625 | A1 * | 10/2003 | Tanaka et al. | 399/159 X |

FOREIGN PATENT DOCUMENTS

| | | |
|---|---|---|
| JP | 54-143645 | 11/1979 |
| JP | 61-100780 | 5/1986 |
| JP | 61-278861 | 12/1986 |
| JP | 1-34205 | 10/1989 |
| JP | 2745726 | 2/1998 |
| JP | 2002-364633 | 12/2002 |

* cited by examiner

IMAGE FORMING METHOD CAPABLE OF MAINTAINING SUSTAINED STABLE CLEANING PERFORMANCE WITHOUT CAUSING AN IMAGE SMEARING PHENOMENON EVEN WITH A HIGH STRENGTH AND HIGH ABRASION IMAGE BEARING MEMBER

BACKGROUND OF THE INVENTION

1. Field of the Invention

The present invention relates to an image forming method utilizing an electrophotographic process.

2. Related Background Art

An electrophotographic system is widely employed in an image forming apparatus for example a copying apparatus, a printer or a facsimile for forming an image on a recording medium such as paper. In the electrophotographic system, an image bearing member such as a photosensitive member is uniformly charged on a surface thereof, which is irradiated with a laser light to generate a potential difference between an irradiated portion and a non-irradiated portion thereby forming an electrostatic latent image. Then a charged toner is deposited on the surface of the image bearing member, thereby developing the electrostatic latent image on the surface of the image bearing member as a toner image. Thereafter, the toner image is transferred onto a recording medium to form an image thereon.

As charging means for charging the surface of the image bearing member, a corona discharge apparatus or a contact charging apparatus is utilized. The corona discharge apparatus is effective for charging the surface of the image bearing member at a specified potential, but involves drawbacks of requiring a high voltage source and generating ozone. On the other hand, the contact charging apparatus charges the surface of the image bearing member at a specified potential by contacting a voltage-applied conductive charging member with the surface of the image bearing member, and has features of not requiring a high voltage source, a much smaller ozone generation in comparison with the corona discharge apparatus, and a simpler structure.

As the toner image is formed repeatedly on the surface of the image bearing member, it is necessary to sufficiently remove, after the toner image transfer to the recording medium, a residual toner which is not transferred thereto but remains on the surface of the image bearing member. As a cleaning member in such electrophotographic system, there is employed a cleaning blade, which is a counter blade constituted of an elastic material. A method of eliminating the residual toner by contacting such cleaning blade with the surface of the image bearing member is widely utilized because of a low cost, a simple and compact configuration in the entire electrophotographic system and an excellent toner eliminating efficiency. Such cleaning blade is generally constituted of urethane rubber, which has a high hardness and a high elasticity and is satisfactory in an abrasion resistance, a mechanical strength, an oil resistance and an ozone resistance.

Physical properties of the cleaning blade and a mode of contact thereof with the image bearing member are significantly affected by an ease of cleaning depending on a level of adhesion of the transfer residual toner to the image bearing member and a surface property of the image bearing member. Also since the cleaning property is significantly influenced by physical properties of the toner such as a shape, a particle size and a material thereof, it is necessary to select a blade matching the toner and to set an angle and a contact load appropriate for the image bearing member.

A higher image quality and a lower running cost are recent requirements for the image forming apparatus. In the photosensitive member employed as the image bearing member in the electrophotographic system, a thinner photosensitive layer is adopted for achieving a higher image quality, and, for a lower running cost, improvements are being made on an electrical strength, a mechanical strength and an abrasion resistance of the surface of the photosensitive member, in order to extend the service life of the photosensitive member.

However, an image forming apparatus employing such image bearing member is found to have the following drawbacks.

In an image bearing member of a high durability having a high strength and a high abrasion resistance, particularly in an image bearing member of a very high abrasion resistance showing a surface abrasion of 2 mg or less in a Taber abrasion tester, the image bearing member is hardly refreshed by a surface scraping and tends to accumulate, over a prolonged period, an electrical damage by charging, a surface deterioration by a deposition of discharge products, and a mechanical damage caused by a friction with the cleaning blade. Also a sliding property of the surface of the image bearing member (particularly that to the cleaning blade) is lowered to cause a vibration, a squeaking and a tuck-up of the cleaning blade. Also as the surface of the image bearing member is not easily scraped, the discharge products are not easily removable thereby leading to an image deletion. Therefore, various measures have been proposed for solving this drawback.

As an example, Japanese Utility Model Publication No. H01-34205 proposes a method of heating the image bearing member with a heater, thereby avoiding a low electrical resistance on the surface of the image bearing member caused by a moisture adsorption and preventing image smearing. However, such heater, also requiring thermal control means, complicates the configuration of the image forming apparatus, also leading to a complication in the system against the trend of the copying machine and the printer toward a compacter and more personal system. Also such heater requires a certain temperature elevating time, involving a long warm-up time from the start of power supply to the actual printing operation, and also involving an electric power for this purpose. Also the heating of the image bearing member, close to a glass transition temperature (Tg) of the toner, may cause sticking of the toner onto the surface of the image bearing member.

Japanese Patent Application Laid-open No. S61-100780 discloses another method to eliminate the discharge products by rubbing the surface of the image bearing member with an elastic roller. This method can provide a sufficient rubbing force, but the transfer residual toner, eliminated from the surface of the image bearing member and sticking to the elastic roller, is carried thereon unless eliminated by other means from the elastic roller, and is repeatedly subjected to a rubbing between the image bearing member and the elastic roller, thus causing a fused adhesion. On the other hand, even when the elimination from the surface of the elastic roller is achieved sufficiently, in case the transfer residual toner is present only in a small amount, the elastic roller comes into direct contact and rubbing with the surface of the image bearing member, thus damaging the surface thereof.

Also, Japanese Patent Application Laid-open No. S61-278861 proposes still another method to use a developer containing an abrasive, thereby actively eliminating the discharge products. This method, which does not require a new member such as a heater or an elastic roller in the aforementioned rubbing method, allows to simplify the apparatus and to reduce the cost thereof.

However, in case an aforementioned contact charging apparatus is employed as the charging means, the abrasive leaking through the cleaning blade may contaminate the contact charging apparatus, thereby inducing an uneven charging to cause an image defect.

SUMMARY OF THE INVENTION

An object of the present invention is to provide an image forming method free from the aforementioned drawbacks.

More specifically, the invention is to provide an image forming method of a long service life, a high image quality and a low running cost, capable of maintaining a stable cleaning performance over a prolonged period without causing an image smearing phenomenon, even with a image bearing member such as a photosensitive member, of a high durability (high strength and high abrasion resistance).

The present inventors, as a result of intensive investigations, have found that a following configuration can provide an image forming method of a long service life, a high image quality and a low running cost, capable of maintaining a stable cleaning performance over a prolonged period without causing an image smearing phenomenon, even with a image bearing member such as a photosensitive member, of a high durability (high strength and high abrasion resistance), and have thus made the present invention.

More specifically, the present invention provides an image forming method including at least a charging step of charging an image bearing member with a charging member, an electrostatic latent image forming step of forming an electrostatic charge image on the charged image bearing member, a developing step of developing the electrostatic charge image with a toner thereby forming a toner image, a transfer step of transferring the toner image, formed on the image bearing member, onto a recording medium either using or without using an intermediate transfer member, a fixing step of heat fixing the toner image onto the recording medium, and a cleaning step of cleaning a surface of the image bearing member after the image transfer with a cleaning member, characterized in that the image bearing member has a universal surface hardness HU of 150 to 220 $N/mm^2$ and an elastic deformation ratio We of 40 to 65%, as measured in a hardness test employing a tetragonal cone diamond indenter pressed under a maximum load of 6 mN in an environment of a temperature of 25° C. and a humidity of 50%, that the charging member is a contacting charging roller so provided as to be brought into contact with the image bearing member, that a rotary axis of the contact charging roller and a rotary axis of the image bearing member mutually cross with a crossing angle θ (°), that the cleaning member is a cleaning blade so provided as to be brought into contact with the image bearing member, that abrasive particles are present in a contact portion of the cleaning blade and the image bearing member, and that, for a ratio A (% by weight) of the transfer residual toner reaching the cleaning blade and the abrasive particles and for a contact pressure B (g/cm) of the cleaning blade, HU, We, A, B and θ satisfy the following relations (I), (II) and (III):

$$(1/6000)\times HU\times We \leqq A\times B \quad \text{(I)}$$

$$A/B \leqq \theta \quad \text{(II)}$$

$$10 \leqq B \leqq 50 \quad \text{(III)}.$$

In the present invention, HU, We, A, B and θ used in the relations (I), (II) and (III) mean numerical values.

Thus the present invention provides an image forming method of a long service life, a high image quality and a low running cost, capable of maintaining a stable cleaning performance over a prolonged period without causing an image smearing phenomenon, even with a image bearing member such as a photosensitive member, of a high durability (high strength and high abrasion resistance).

DETAILED DESCRIPTION OF THE PREFERRED EMBODIMENTS

Figure 1:
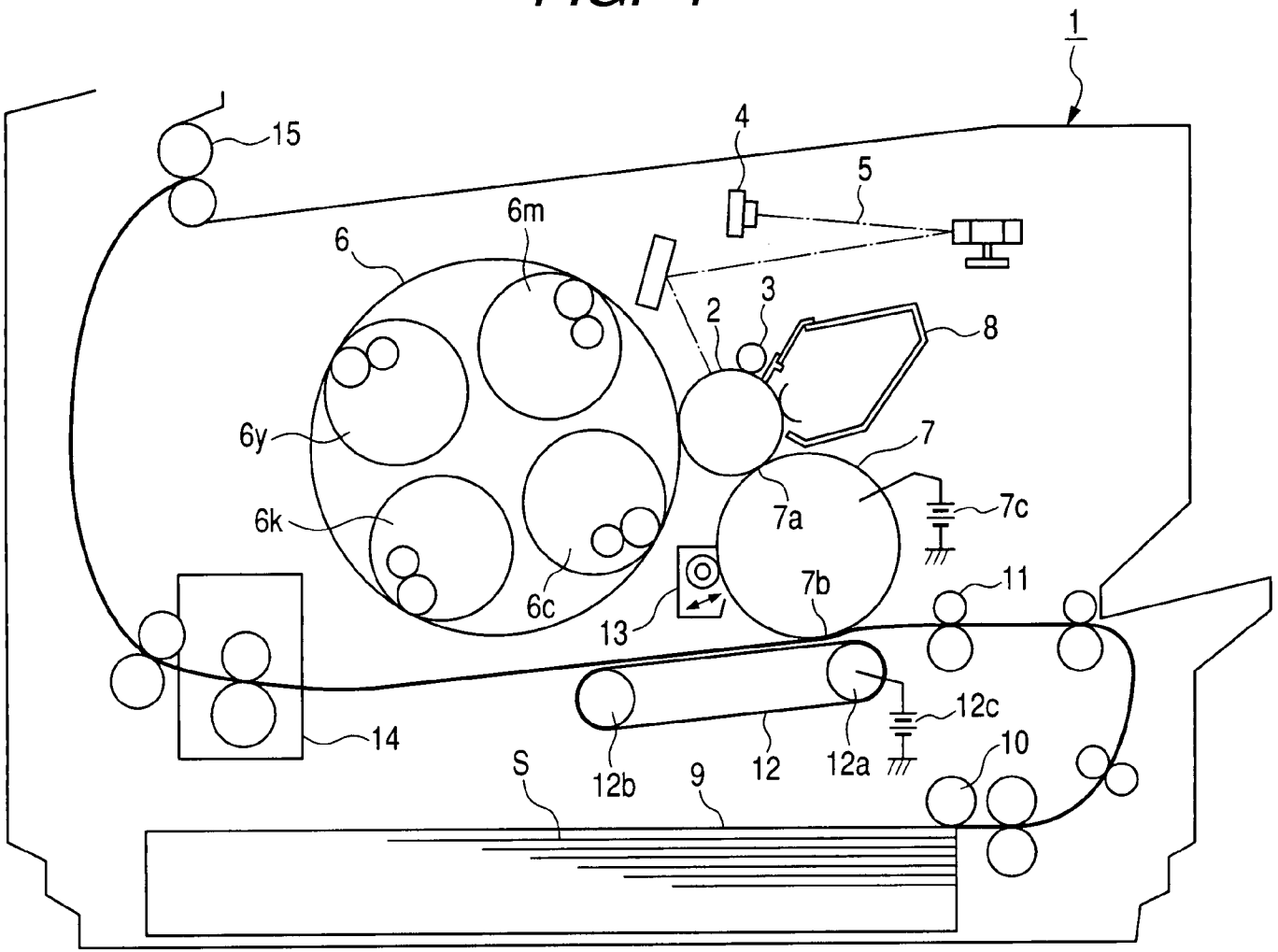
FIG. 1 is a schematic cross-sectional view showing a configuration of an image forming apparatus suitable for the present invention.

In the following there will be explained an image forming apparatus utilizing an image forming method of the present invention, with reference to the accompanying drawings. FIG. 1 is a schematic view showing a configuration of an image forming apparatus adapted for use in the invention.

(Structure of Image Forming Apparatus)

An image forming apparatus 1 shown in FIG. 1 is a full-color image forming apparatus of an electrophotographic process, and forms an image on a recording medium S according to an image signal supplied for example from an unillustrated computer. An image bearing member 2 is constituted of a photosensitive member.

The image bearing member 2 is charged, while being rotated with a peripheral speed of 200 mm/sec, at a dark area potential VD of −600 V by a charging member 3 such as a contact charging roller. Then it is scan exposed to an exposure light 5, such as a laser beam which is on/off controlled according to image information by electrostatic latent image forming means 4 such as a laser oscillator, whereby an electrostatic latent image with a light area potential VL of −200 V is formed on the image bearing member 2.

The thus formed electrostatic latent image is developed and rendered visible with a toner constituting a developer, in developing means 6 such as a rotary developing apparatus. The developing means 6 integrally includes a first developing apparatus **6*y* containing a yellow toner as a toner of a first color, a second developing apparatus 6*m* containing a magenta toner as a toner of a second color, a third developing apparatus 6*c* containing a cyan toner as a toner of a third color, and a fourth developing apparatus 6*k*** containing a black toner as a toner of a fourth color.

At first, a first electrostatic latent image is developed and rendered visible by the first developing apparatus **6*y*** containing the yellow toner as a toner of a first color. The development may be executed by any method of a jumping development method, a two-component development method and a FEED development method. Also an image-wise exposure and a reversal development are often employed in combination. The present embodiment employs a two-component development method utilizing a non-magnetic toner.

The thus developed toner image of the first color is, in a first transfer portion 7*a* opposed to an intermediate transfer member 7 rotatively driven, electrostatically transferred (primary transfer) onto the surface of the intermediate transfer member 7. The intermediate transfer member 7 is formed of a conductive elastic layer and a surface layer having a release property, and has a circumferential length somewhat longer than a length of a maximum conveyable recording medium. The intermediate transfer member 7, pressed to the image bearing member 2 under a predetermined pressing force, is rotated with a peripheral speed substantially same as that of the image bearing member 2, in a direction opposite to the rotating direction of the image bearing member 2 (namely in a same direction in the contacting portion between both the members).

The intermediate transfer member 7 is given, in a cylinder portion thereof, a voltage (primary transfer bias) of a polarity opposite to the charging polarity of the toner from a high voltage source 7*c*, whereby the toner image is primarily transferred onto the surface of the intermediate transfer member 7. A toner remaining on the surface of the image bearing member 2 after the primary transfer is removed by a cleaning apparatus 8 to be explained later. Thereafter the aforementioned steps are repeated for different colors to transfer toner images of four colors in superposed manner on the intermediate transfer member 7.

Recording media S, stacked on a cassette 9, are separated and fed one by one by a pickup roller 10, and the recording medium reaches a secondary transfer portion 7*b* after a skew correction by paired registration rollers 11. Then transfer means 12 such as a transfer belt, maintained in a separated state from the surface of the intermediate transfer belt 7, is pressed to the surface thereof under a predetermined pressing force and is rotated. The transfer means 12 is put over a bias roller 12*a* and a tension roller 12*b* under a tension, and the bias roller 12*a* receives a voltage (secondary transfer bias) of a polarity opposite to the charging polarity of the toner from a high voltage source 12*c*.

Thus, onto the surface of the recording medium S conveyed to the second transfer portion 7*b* at a predetermined timing, the toner images on the intermediate transfer member 7 are collectively transferred (secondary transfer), and the recording medium is then conveyed to fixing means 14 for an image fixation by heat and pressure and is discharged from the apparatus by paired discharge rollers 15. A toner remaining on the surface of the intermediate transfer member 7 after the secondary transfer is removed by an intermediate transfer member cleaning apparatus 13 which is brought into contact with the surface of the intermediate transfer member 7 at a predetermined timing.

(Image Bearing Member)

In the following, there will be explained a photosensitive member, constituting an image bearing member to be employed in the invention (image bearing member being hereinafter also referred to as photosensitive member or photosensitive drum).

A photosensitive member to be employed in the image forming method of the invention has a universal surface hardness HU of 150 to 220 N/mm$^2$ and an elastic deformation ratio We of 40 to 65% as measured in a hardness test employing a Vickers tetragonal cone diamond indenter in an environment of a temperature of 25° C. and a humidity of 50% and pressing the indenter into the surface of the photosensitive member under a maximum load of 6 mN. It is preferred that the universal hardness HU is within a range of 160 to 200 N/mm$^2$, and that the elastic deformation ratio We is within a range of 50 to 65%.

In the invention, the universal hardness HU and the elastic deformation ratio We were measured with a micro-hardness measuring apparatus Fischer-Scope H100V, manufactured by Fischer Inc., capable of applying a load continuously on an indenter and directly reading an indentation depth under the load thereby determining the hardness in continuous manner. There was employed a Vickers tetragonal cone diamond indenter with a face angle of 136°. The measurement was conducted under stepped loads (273 levels with a holding time of 0.1 seconds at each level) up to a maximum load of 6 mN.

The universal hardness (also represented as HU) is defined by the following formula (1), based on an indentation depth under a load of 6 mN.

$$HU=(\text{test load } (N))/(\text{surface area } (\text{mm}^2) \text{ of Vickers indenter under test load})=0.006/26.43h^2 \quad (1)$$

The elastic deformation ratio We is determined from a work load (energy) exerted by the indenter on the film, namely from a change in the energy due to an increase or decrease of a load of the indenter on the film, and can be calculated from the following formula (2):

$$\text{elastic deformation ratio } We\ (\%)=Wo/Wt\times 100 \quad (2)$$

wherein Wt (nW) is a total work load, and Wo (nW) is a work load of elastic deformation.

An improvement in the durability against mechanical deterioration is one of requirements for the photosensitive member, as described before. In general, a hardness of a film becomes higher as a deformation by an external strain is smaller, and it is generally expected, also in an electrophotographic photosensitive member, that the electrophotographic photosensitive member with a higher pencil hardness or a higher Vickers hardness shows improved durability to the mechanical deterioration. However, it is found that a photosensitive member with a higher hardness obtained in the measurement in respect of these hardness does not necessarily have improved durability to the mechanical deterioration. More specifically, a photosensitive member is found to be hardly subjected to the mechanical deterioration in case where it has a universal surface hardness HU of 150 to 220 N/mm$^2$ and an elastic deformation ratio We of 40 to 65% as measured in a hardness test employing a Vickers tetragonal cone diamond indenter pressed under a maximum load of 6 mN.

An abrasion amount in the surface of the photosensitive member, constituting the image bearing member of the present embodiment, is 2 mg or less in a Taber abrasion tester, but an abrasion amount of 6 mg or less is sufficiently effective for the durability. The Taber abrasion test is conducted by mounting a sample on a sample table of a Taber abrasion tester (Y.S.S. Taber, manufactured by Yasuda Seisakusho Co.), then a load of 500 gr. is applied on each of two rubber abrading wheels (CS-0) equipped with a lapping tape (trade name: C2000, manufactured by Fuji Photo Film Co.), and a weight loss of the sample after 1,000 turns is measured with a precision balance.

The photosensitive member to be employed in the present invention preferably includes at least a substrate and a photosensitive layer on the substrate. Such photosensitive layer can be a photosensitive layer of a single-layer type containing a charge generation substance and a charge transport substance in a same layer, or a photosensitive layer of a multi-layer type formed by laminating a charge generation layer containing a charge generation substance and a charge transport layer containing a charge transport substance in this order or in an inverted order. Among these, there is preferred a multi-layer type photosensitive layer in consideration of characteristics required of a photosensitive member, particularly electrical characteristics such as a residual potential and durability. Further, a surface protective layer may be formed on the photosensitive layer. In order to obtain a universal hardness HU of 150 to 220 $N/mm^2$ and an elastic deformation ratio We of 40 to 65% on the surface of the photosensitive member, the surface layer of the photosensitive member is preferably formed from a curable compound as cured by a polymerization or by a cross-linking. For forming the surface layer of the photosensitive layer, at first there is prepared a coating liquid in which a curable compound, that can be cured by polymerization or cross-linking, is dissolved. Then such coating liquid is coated by a coating method such as dip coating, spray coating, curtain coating or spin coating. Among these, a dip coating method is preferred for efficient mass production of the photosensitive members. After the coating of the coating liquid, the curable compound is cured by polymerization or cross-linking with a method utilizing heat, a light such as visible light or ultraviolet light, or a radiation such as an electron beam or a gamma ray, thereby forming the surface layer of the photosensitive member. Among these, a radiation is preferred in attaining a sufficient hardness without causing a deterioration in the characteristics of the photosensitive member or an increase in the residual potential.

In case of irradiation with an electron beam as a radiation, any electron accelerator of a scanning type, an electron curtain type, a broad beam type, a pulse type or a laminar type can be employed. In case of irradiation with an electron beam, in order to exhibit electrical characteristics and durability in the photosensitive member of the invention, there is preferred an irradiation with an accelerating voltage of 250 kV or less, most preferably 150 kV or less. Also a radiation dose is preferably within a range of 10 to 1,000 KGy, more preferably 30 to 500 KGy. An accelerating voltage exceeding such range tends to increase a damage by the electron beam irradiation on the characteristics of the photosensitive member. Also a radiation dose less than the aforementioned range tends to result in an insufficient curing, and an excessive dose tends to cause a deterioration in the characteristics of the photosensitive member.

A curable compound that can be cured by polymerization or cross-linking is preferably a compound having an unsaturated polymerizable functional group within the molecule, in consideration of a reactivity, a reaction speed and a hardness attainable after the curing, and particularly preferably a compound having at least a functional group selected from the group of an acryl group, a methacryl group and a styrene group.

The compound having the unsaturated polymerizable functional group of the invention is classified into a monomer and an oligomer, by a repetition of a constitutent unit thereof. A monomer means a compound not including a repetition of a structural unit having an unsaturated polymerizable functional group and having a relatively low molecular weight. An oligomer means a polymer in which a structural unit having an unsaturated polymerizable functional group is repeated by a number of about 2 to 20. Also a macronomer having an unsaturated polymerizable functional group only at a terminal of a polymer or an oligomer is also usable as the curable compound to be employed for forming the surface layer of the invention.

Also the compound having an unsaturated polymerizable functional group of the invention is more preferably a charge transporting compound in order to attain a charge transporting function required in the surface layer. It is further preferably an unsaturated polymerizable compound having a positive hole transporting function.

In the following, there are shown preferred examples of the compound having the unsaturated polymerizable functional group.

| No. | examples of compound |
|---|---|
| 1 | 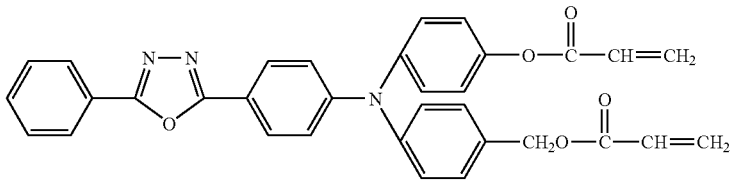 |
| 2 | 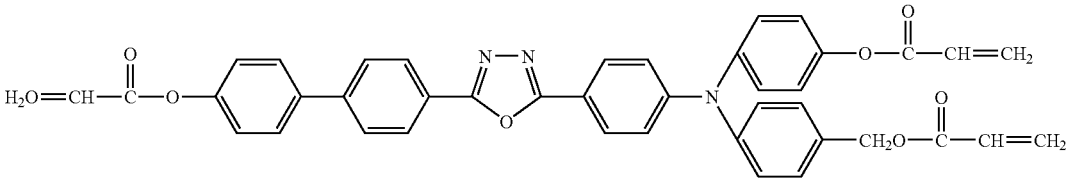 |
| 3 | 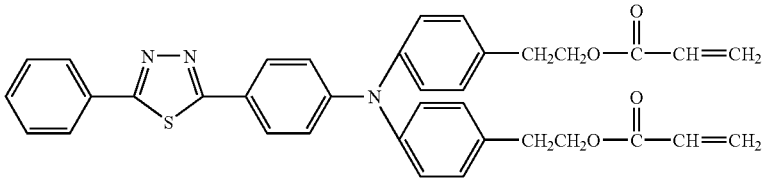 |

-continued
| No. | examples of compound |
|---|---|
| 4 | 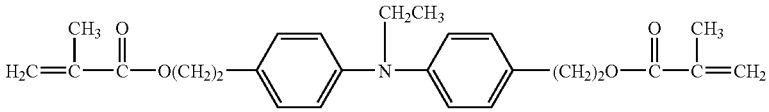 |
| 5 | 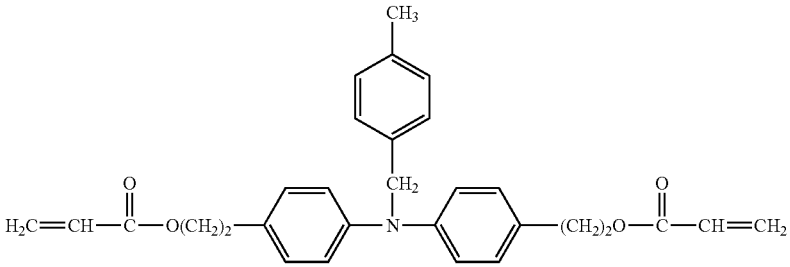 |
| 6 | 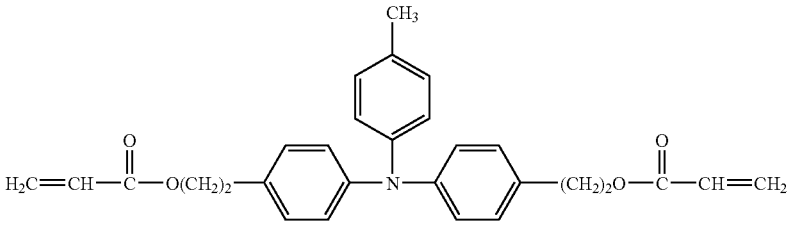 |
| 7 | 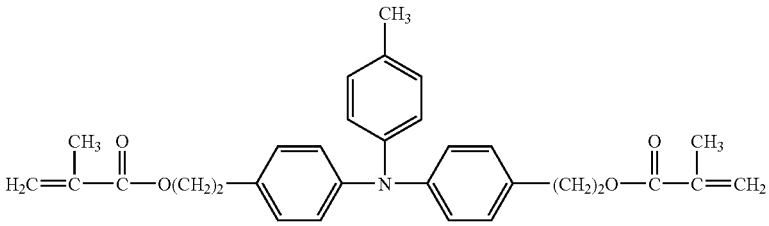 |
| 8 | 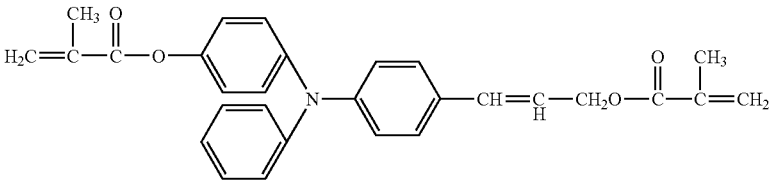 |
| 9 | 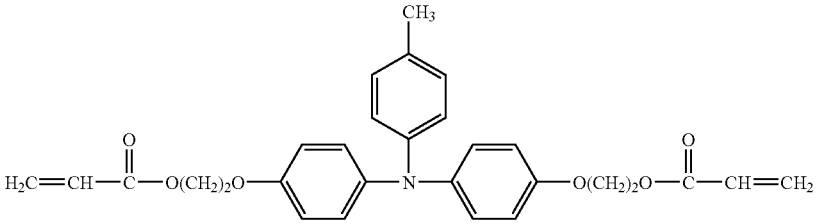 |
| 10 | 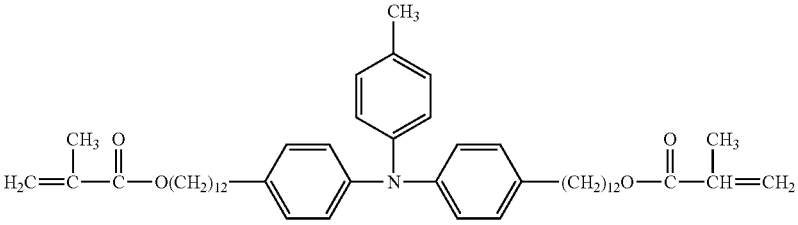 |

-continued
| No. | examples of compound |
|---|---|
| 11 | 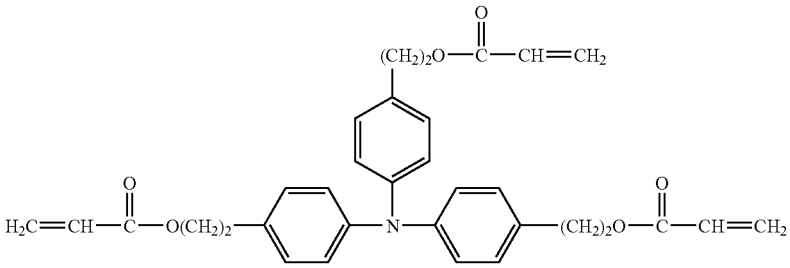 |
| 12 | 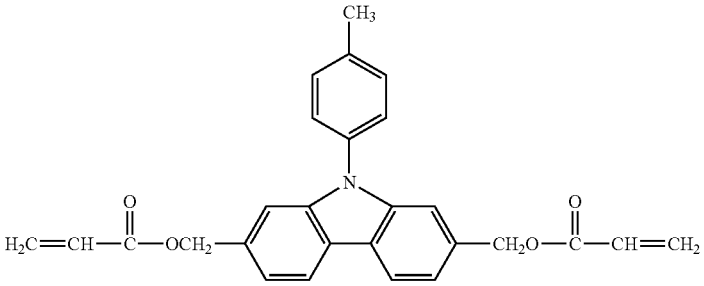 |
| 13 | 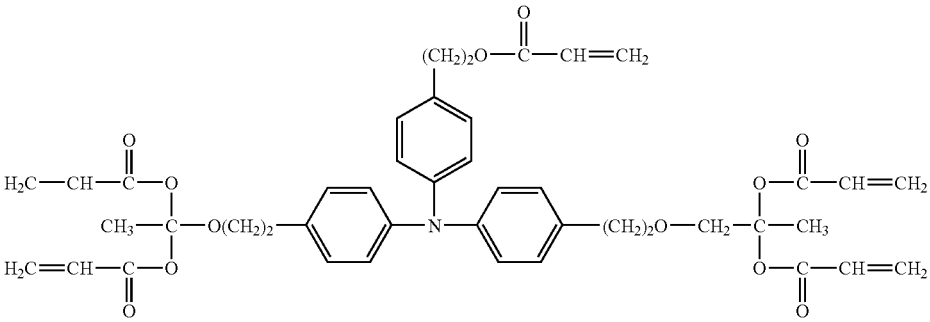 |
| 14 | 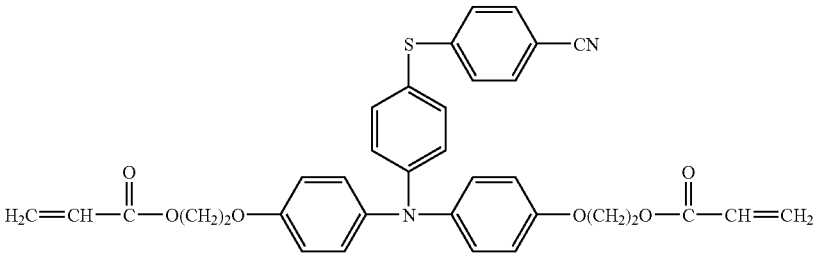 |
| 15 | 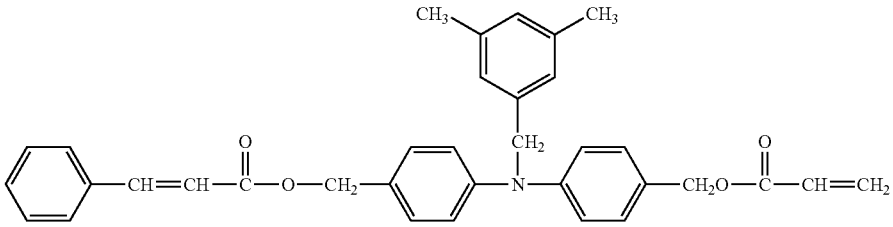 |

-continued
| No. | examples of compound |
|---|---|
| 16 | 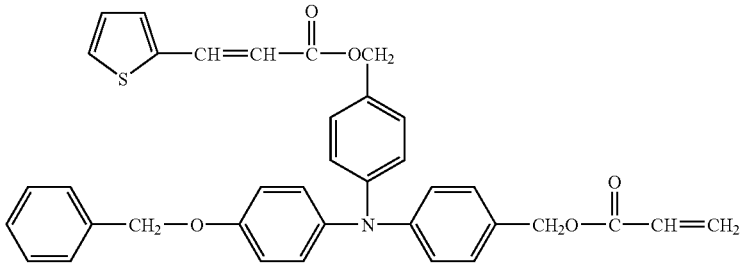 |
| 17 | 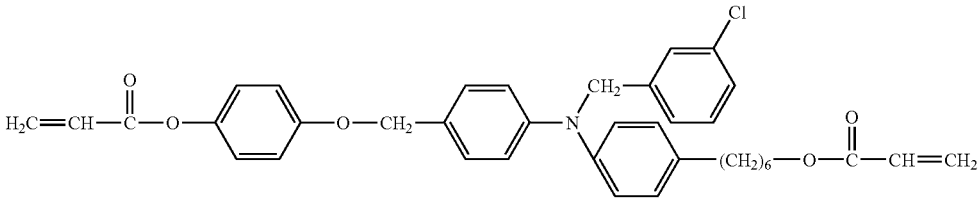 |
| 18 | 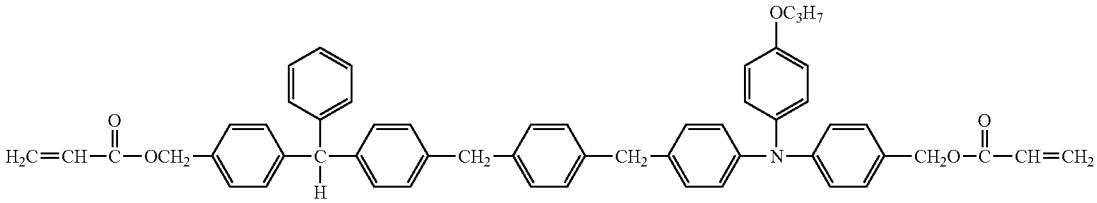 |
| 19 | 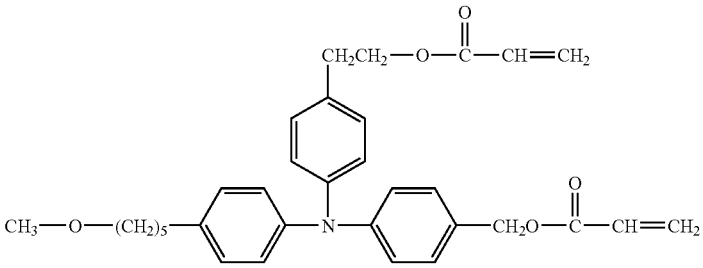 |
| 20 | 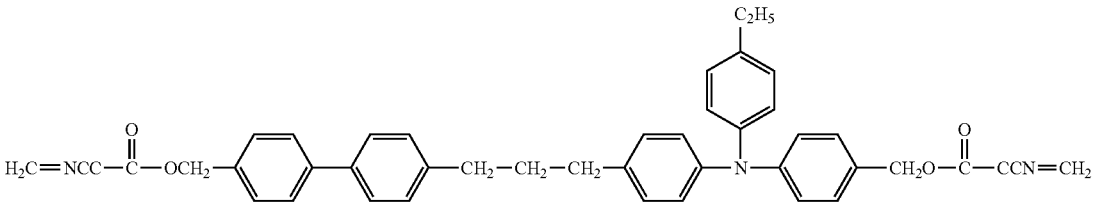 |
| 21 | 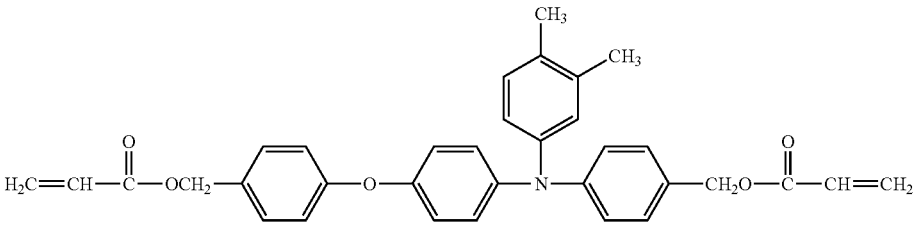 |
| 22 | 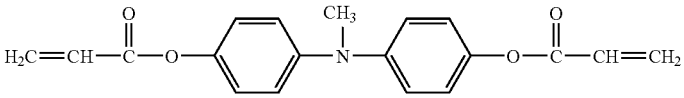 |

-continued
| No. | examples of compound |
|---|---|
| 23 | 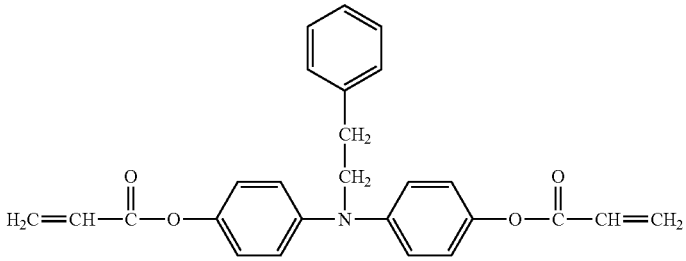 |
| 24 | 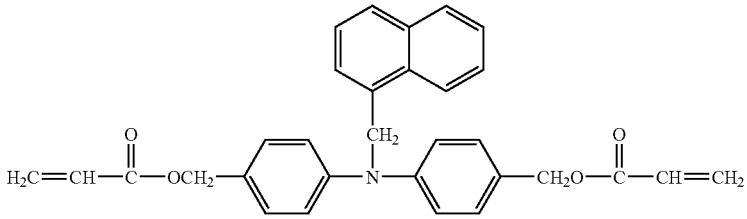 |
| 25 | 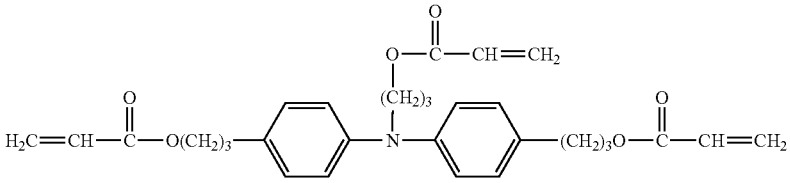 |
| 26 | 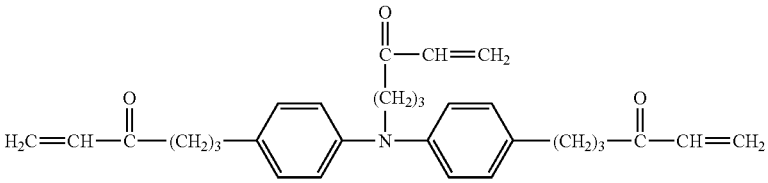 |
| 27 | 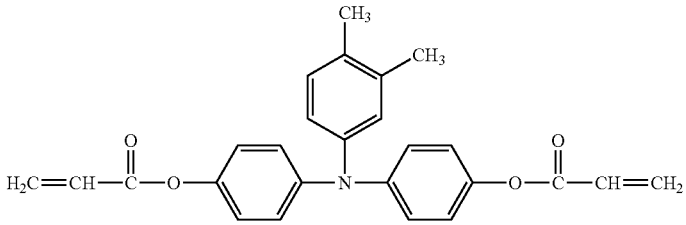 |
| 28 | 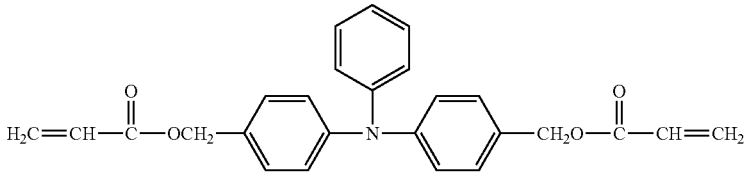 |
| 29 | 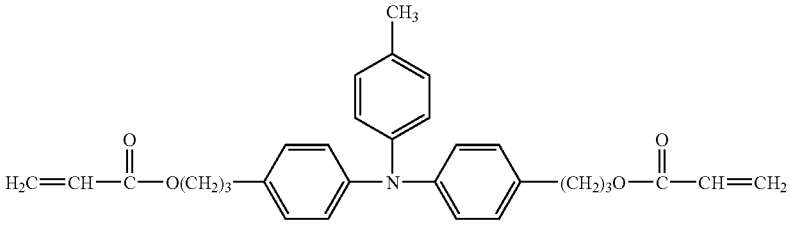 |

-continued
| No. | examples of compound |
|---|---|
| 30 | 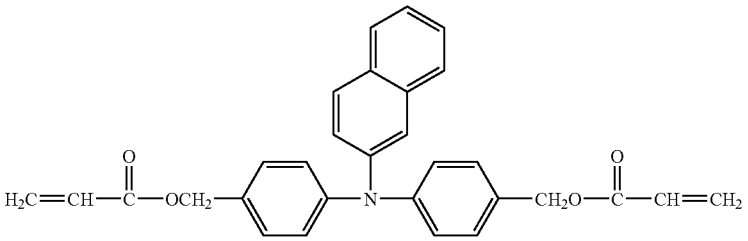 |
| 31 | 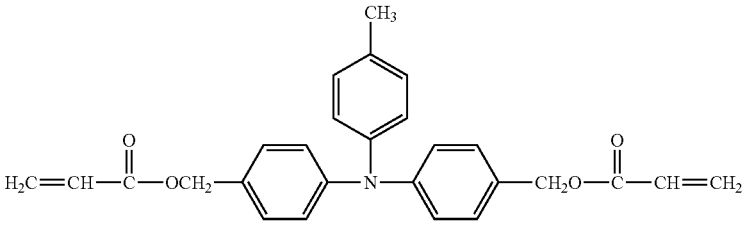 |
| 32 | 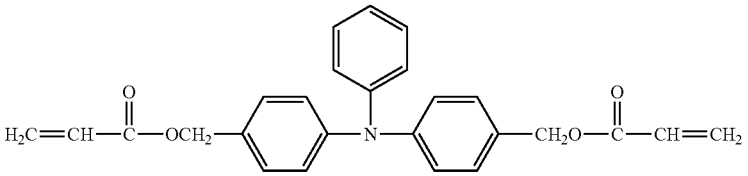 |
| 33 | 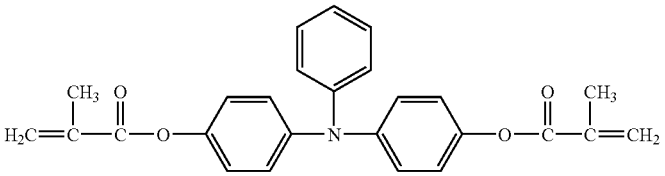 |
| 34 | 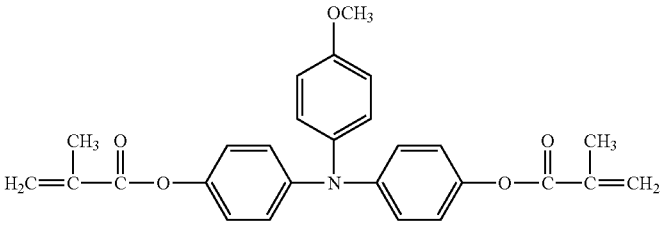 |
| 35 | 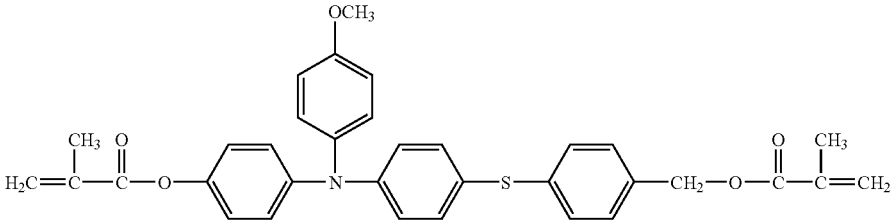 |

-continued
| No. | examples of compound |
|---|---|
| 36 | 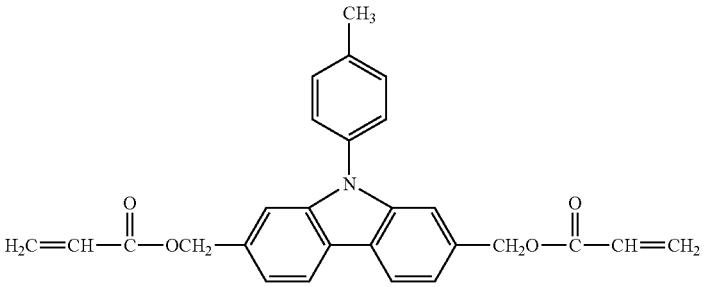 |
| 37 | 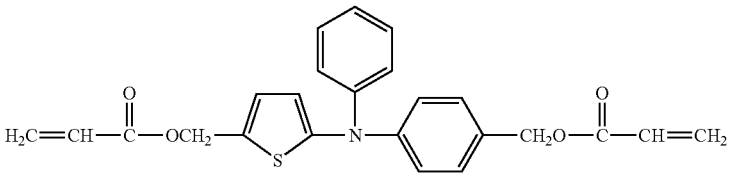 |
| 38 | 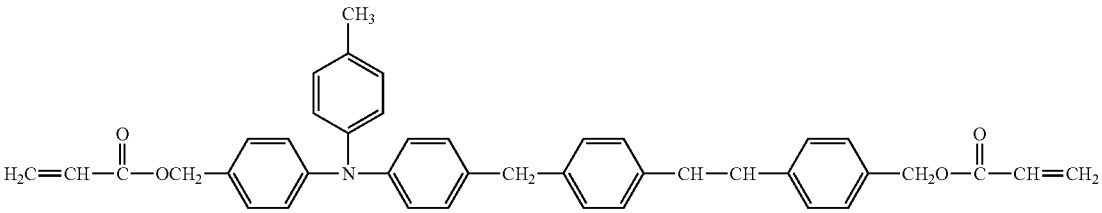 |
| 39 | 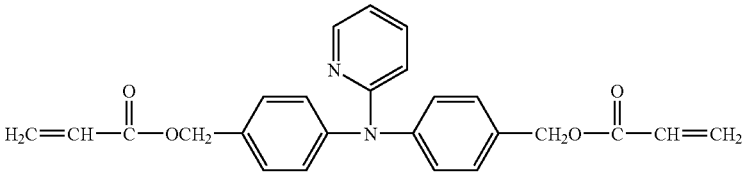 |
| 40 | 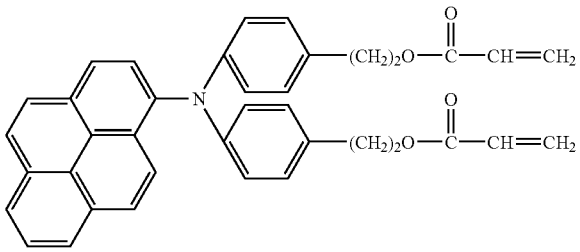 |
| 41 | 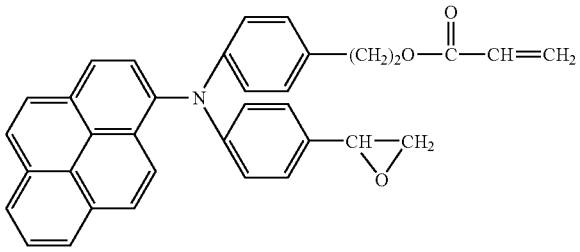 |

-continued
| No. | examples of compound |
|---|---|
| 42 | 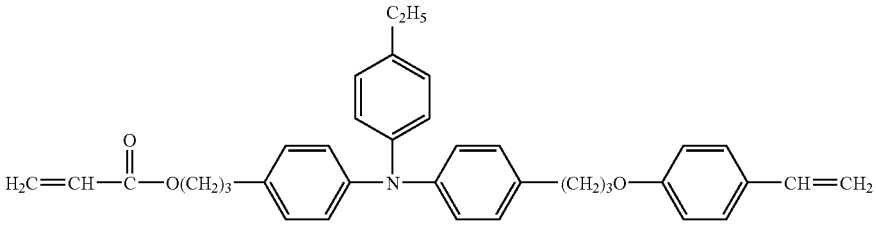 |
| 43 | 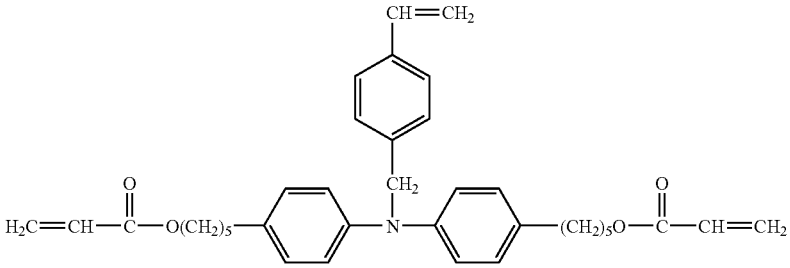 |
| 44 | 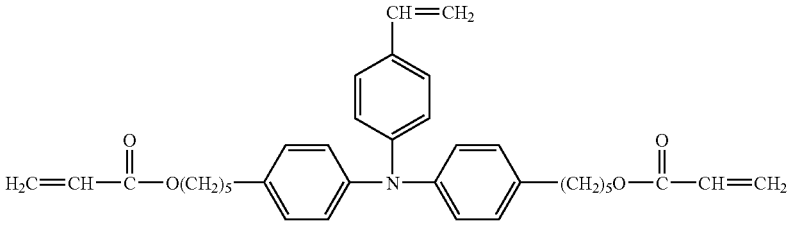 |
| 45 | 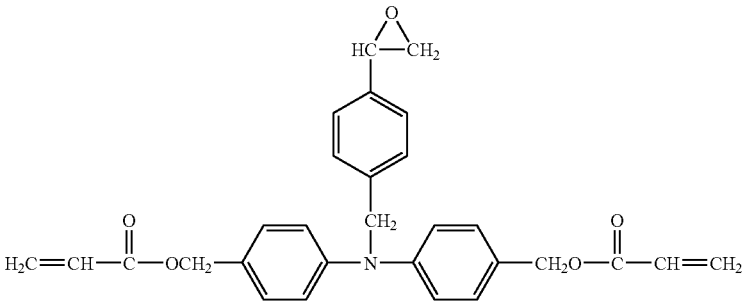 |
| 46 | 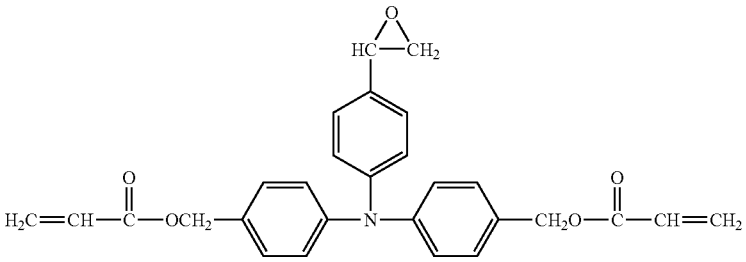 |

-continued
| No. | examples of compound |
|---|---|
| 47 | 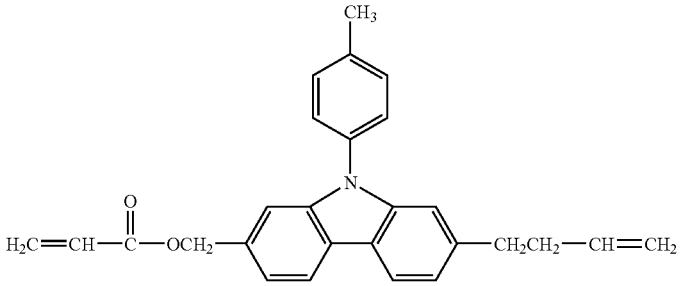 |
| 48 | 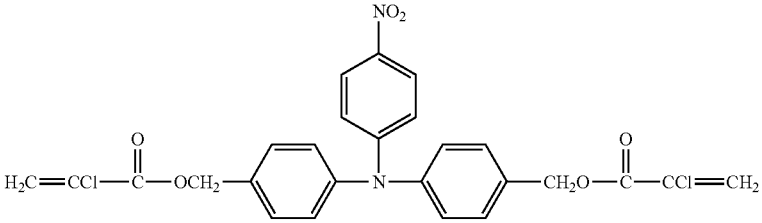 |
| 49 | 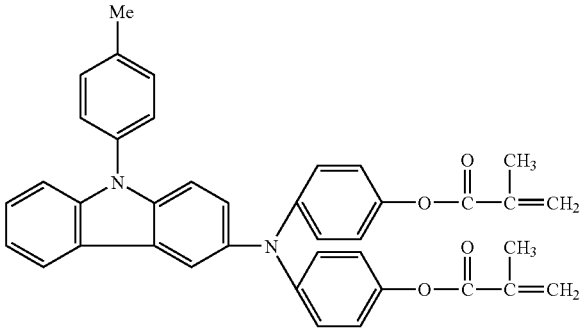 |
| 50 | 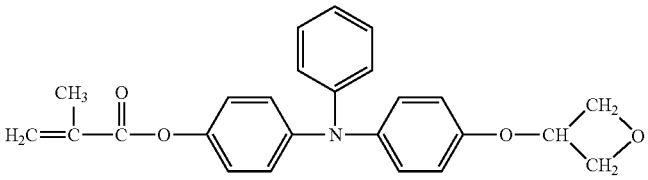 |
| 51 | 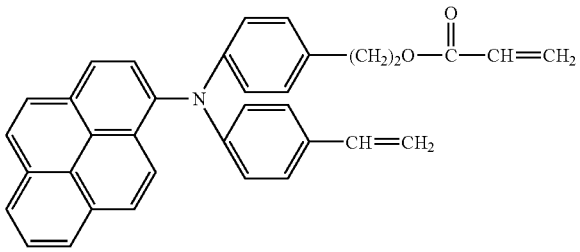 |
| 52 | 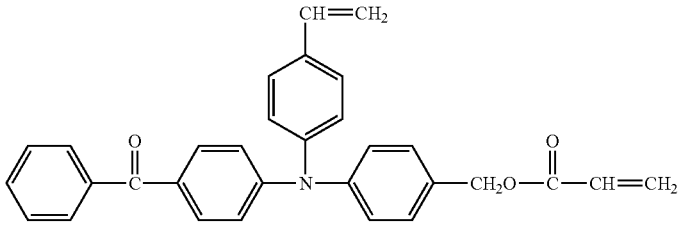 |

-continued
| No. | examples of compound |
|---|---|
| 53 | 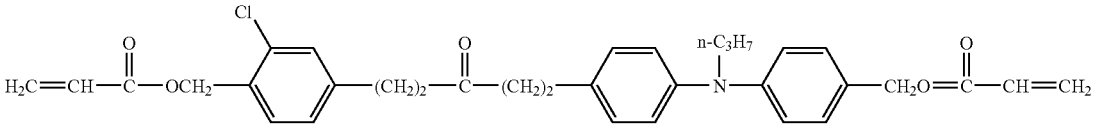 |
| 54 | 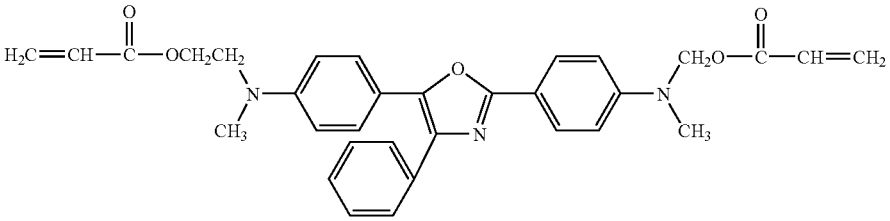 |
| 55 | 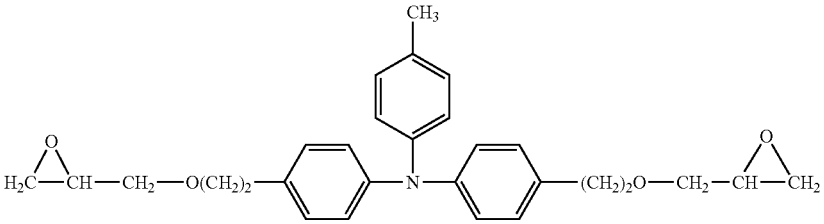 |
| 56 | 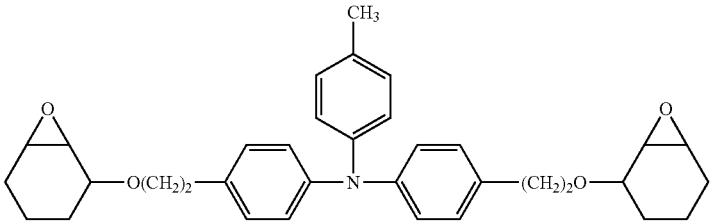 |
| 57 | 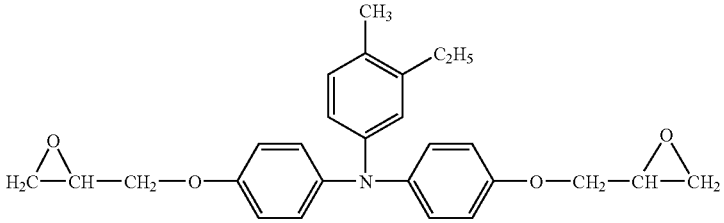 |
| 58 | 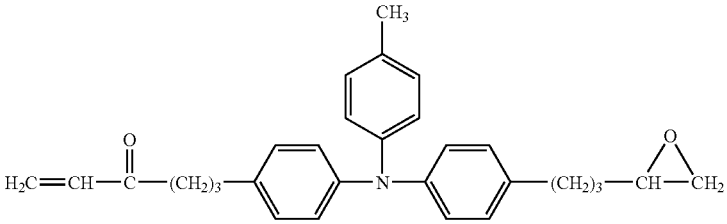 |
| 59 | 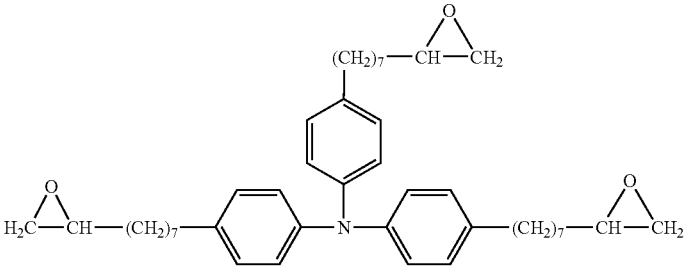 |

-continued
| No. | examples of compound |
|---|---|
| 60 | 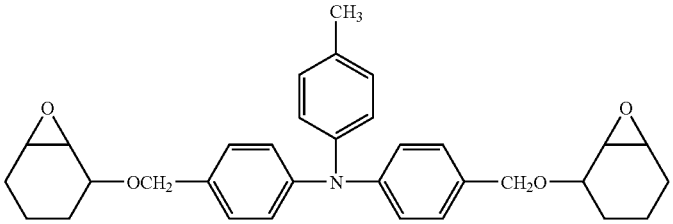 |
| 61 | 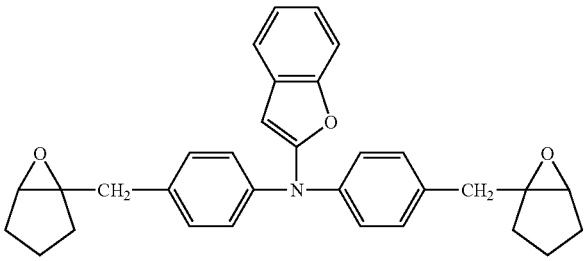 |
| 62 | 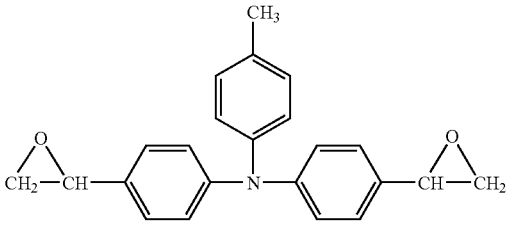 |
| 63 | 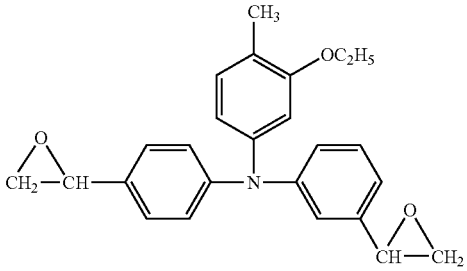 |
| 64 | 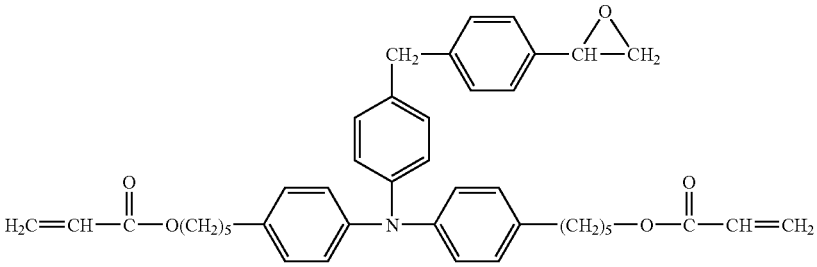 |
| 65 | 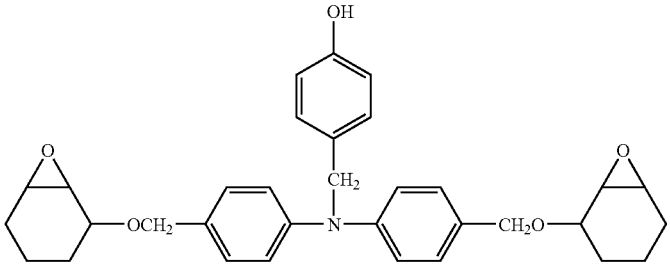 |

-continued
| No. | examples of compound |
|---|---|
| 66 | 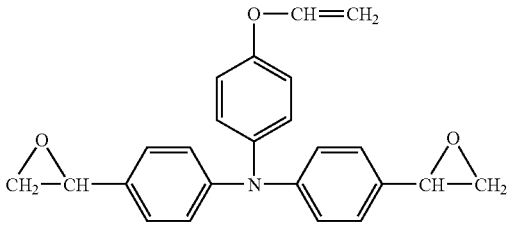 |
| 67 | 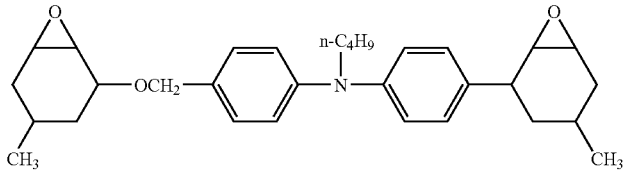 |
| 68 | 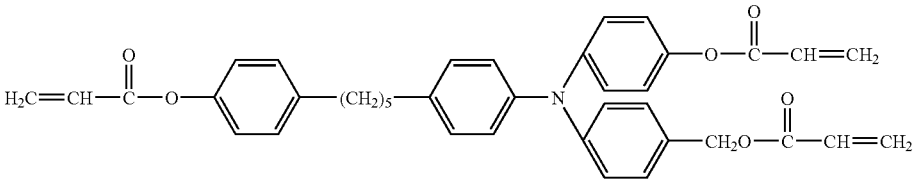 |
| 69 | 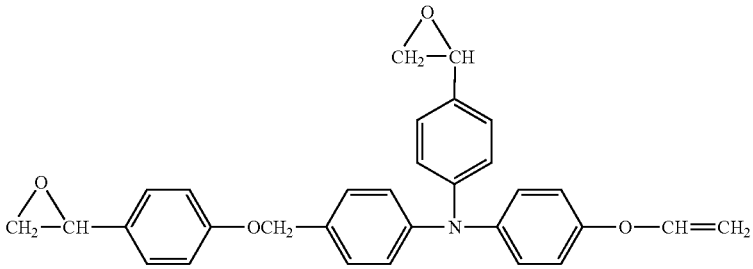 |
| 70 | 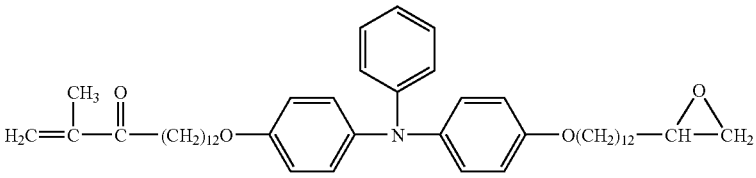 |
| 71 | 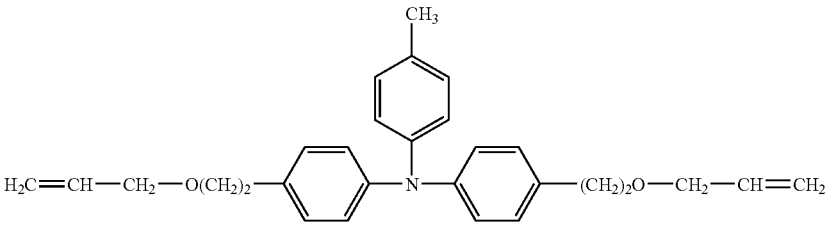 |
| 72 | 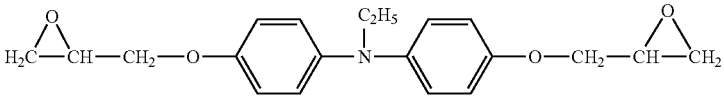 |
| 73 | 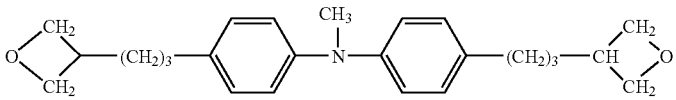 |

-continued
| No. | examples of compound |
|---|---|
| 74 | 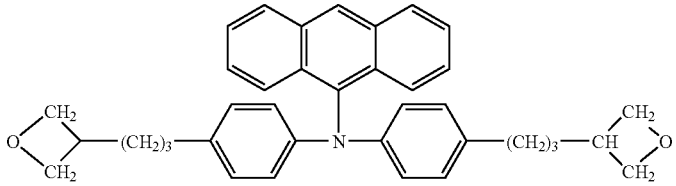 |
| 75 | 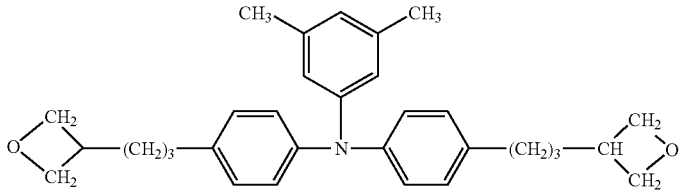 |
| 76 | 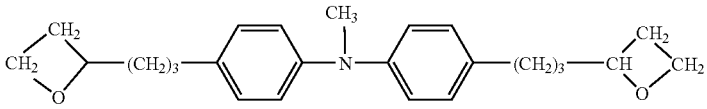 |
| 77 | 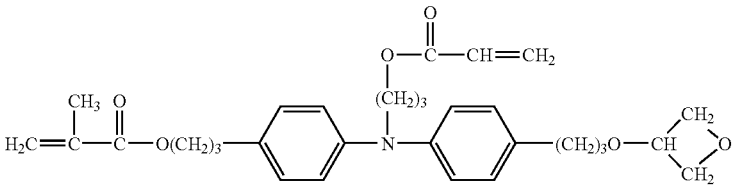 |
| 78 | 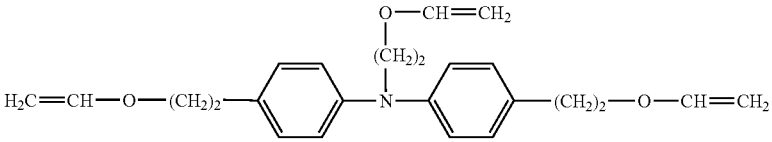 |
| 79 | 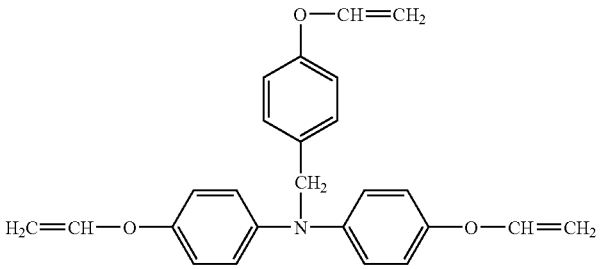 |
| 80 | 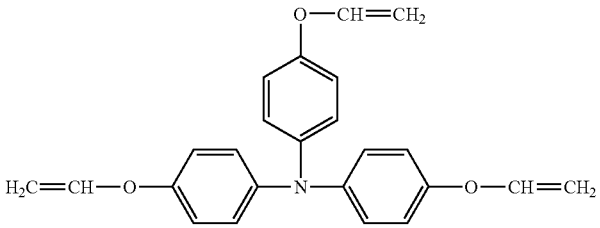 |

-continued
| No. | examples of compound |
|---|---|
| 81 | 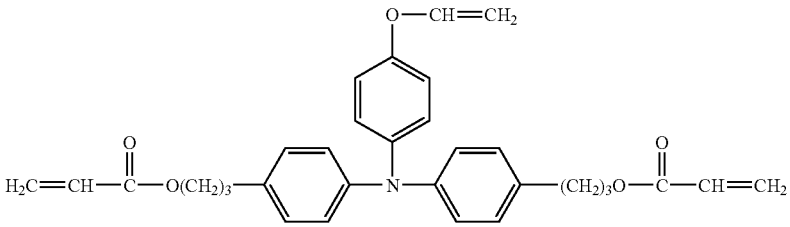 |
| 82 | 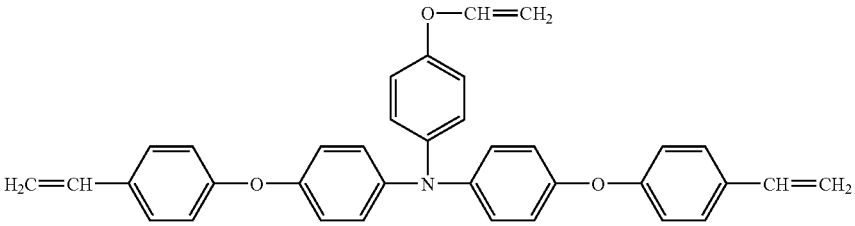 |
| 83 | 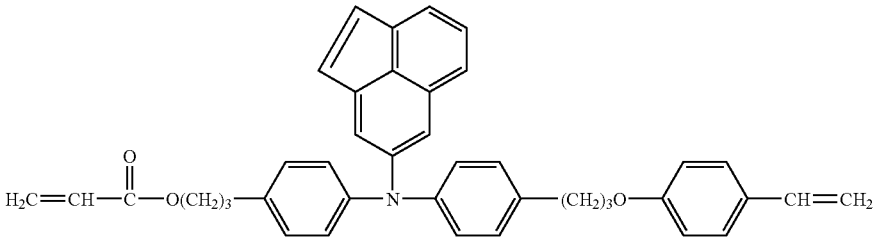 |
| 84 | 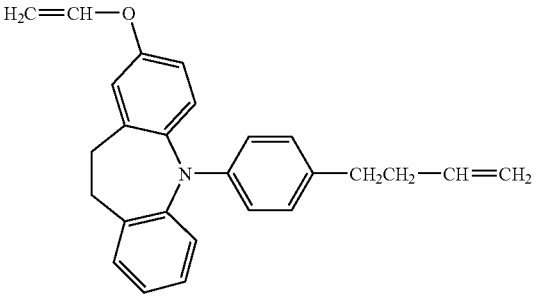 |
| 85 | 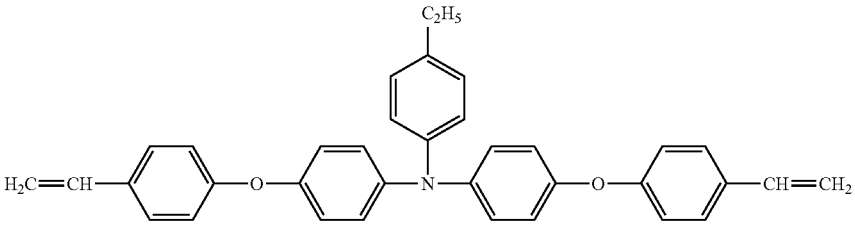 |
| 86 | 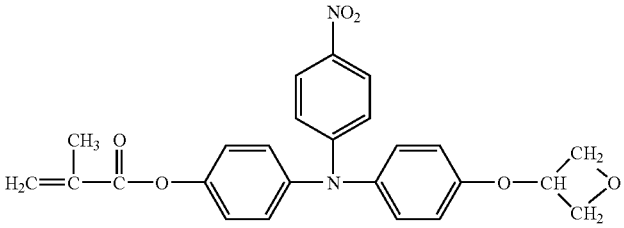 |

-continued
| No. | examples of compound |
|---|---|
| 87 | 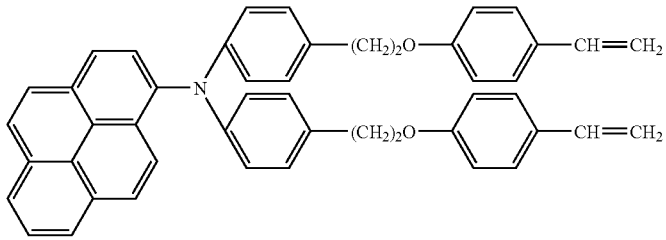 |
| 88 | 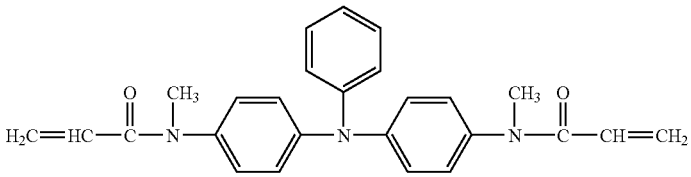 |
| 89 | 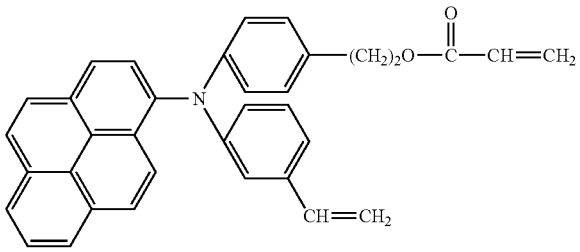 |
| 90 | 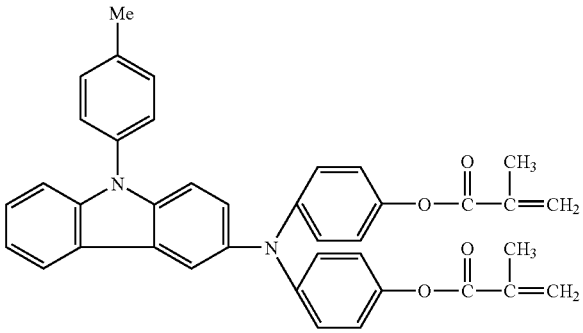 |
| 91 | 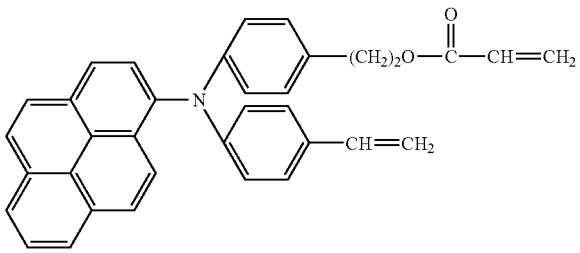 |
| 92 | 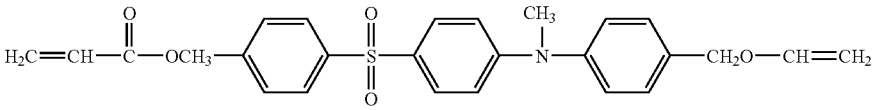 |

-continued
| No. | examples of compound |
|---|---|
| 93 | 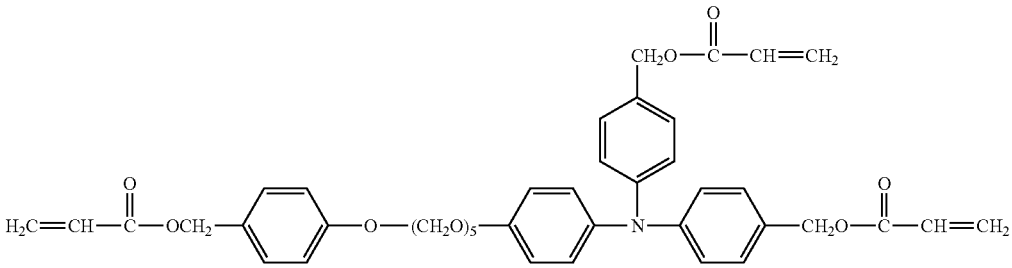 |
| 94 | 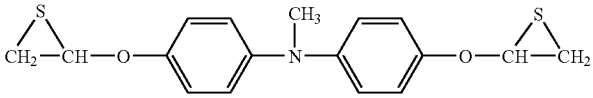 |
| 95 | 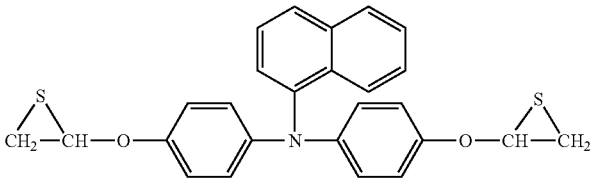 |
| 96 | 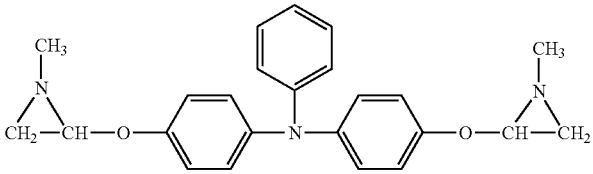 |
| 97 | 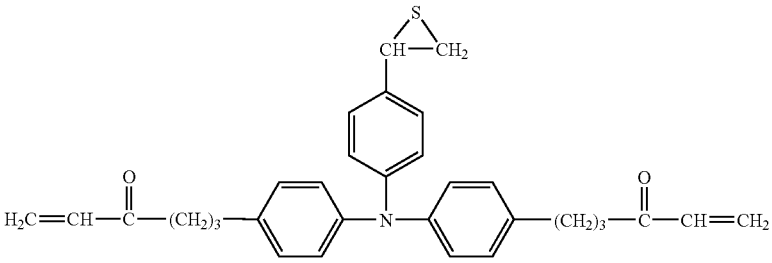 |
| 98 | 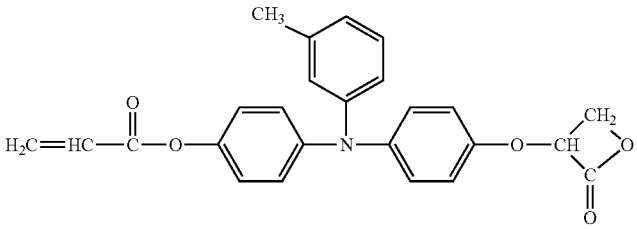 |
| 99 | 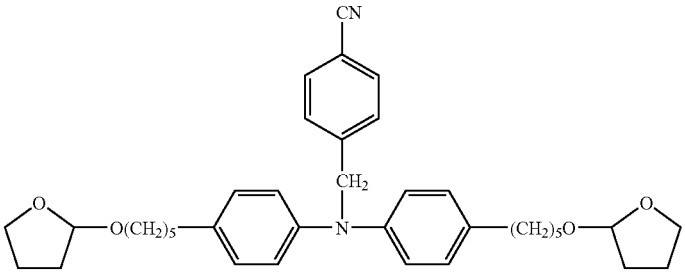 |

-continued
| No. | examples of compound |
|---|---|
| 100 | 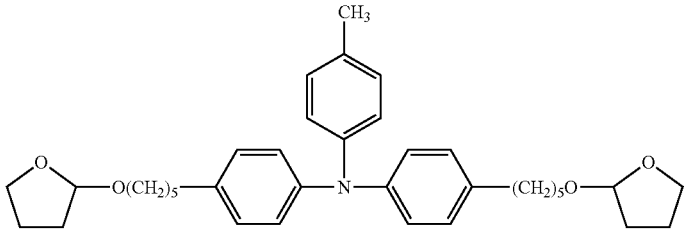 |
| 101 | 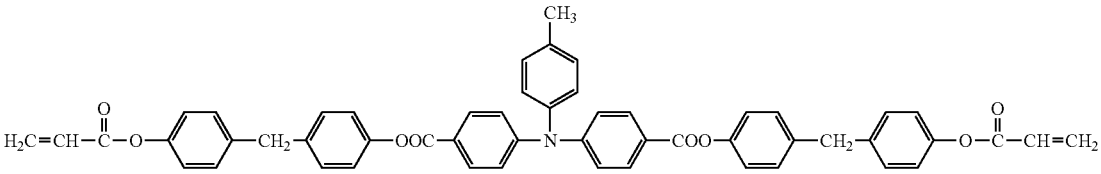 |
| 102 | 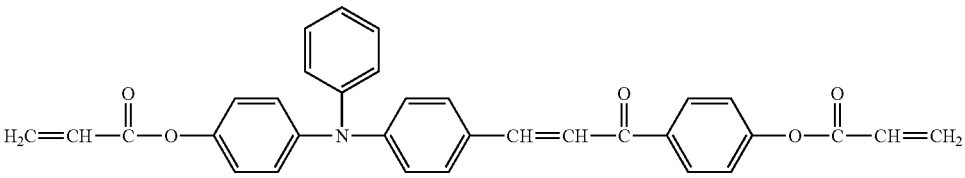 |
| 103 | 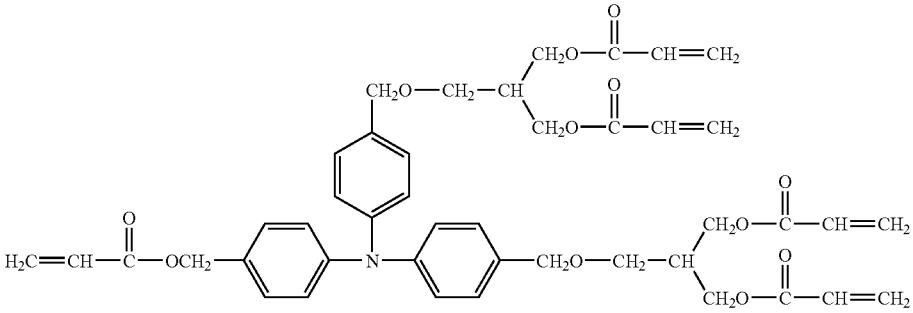 |
| 104 | 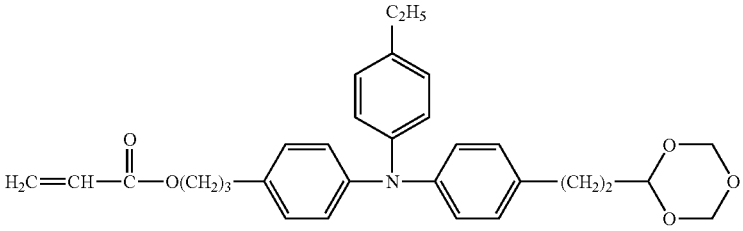 |
| 105 | 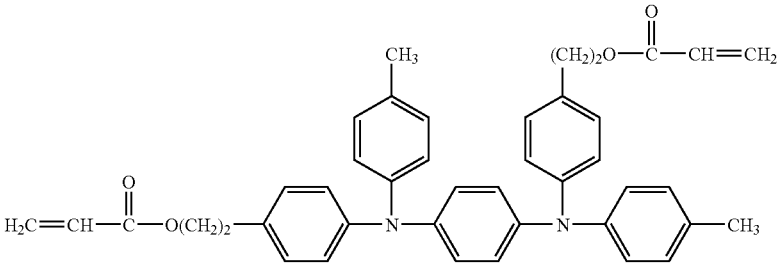 |

-continued
| No. | examples of compound |
|---|---|
| 106 | 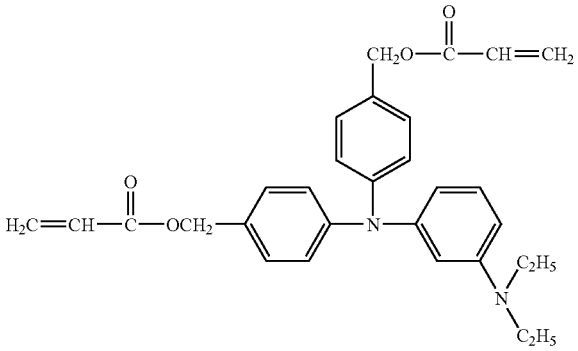 |
| 107 | 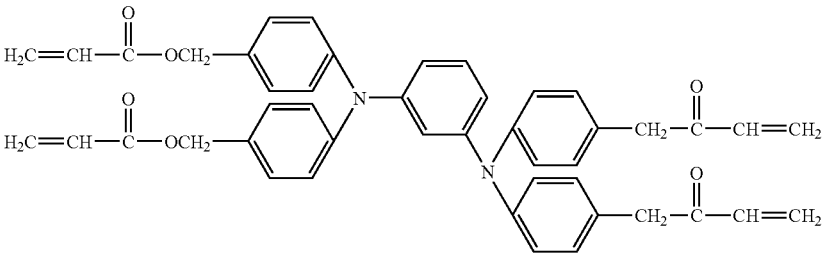 |
| 108 | 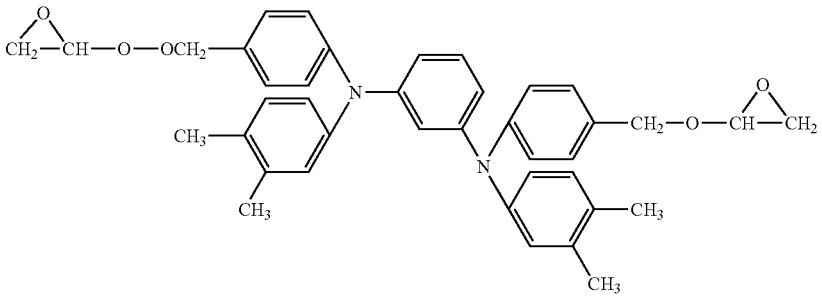 |
| 109 | 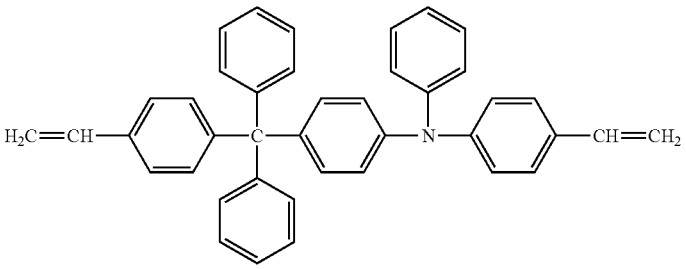 |
| 110 | 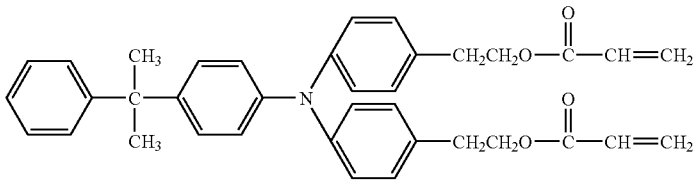 |

-continued
| No. | examples of compound |
|---|---|
| 111 | 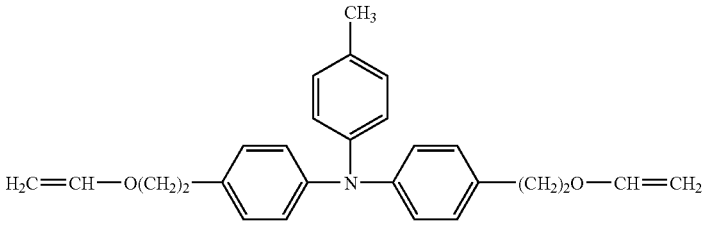 |
| 112 | 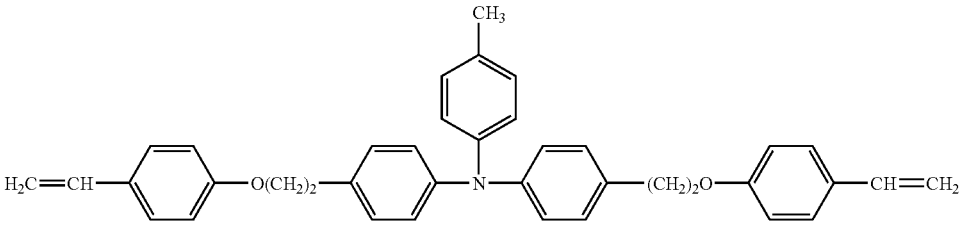 |
| 113 | 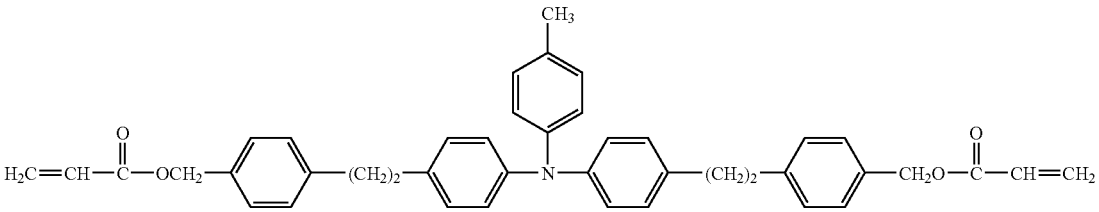 |
| 114 | 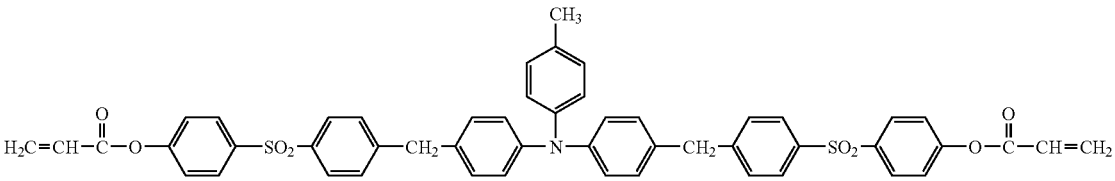 |
| 115 | 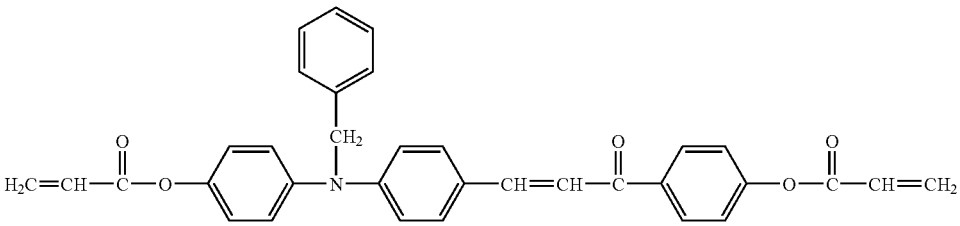 |
| 116 | 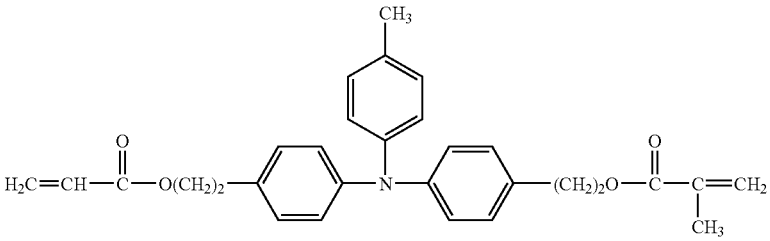 |

-continued

| No. | examples of compound |
|---|---|
| 117 | 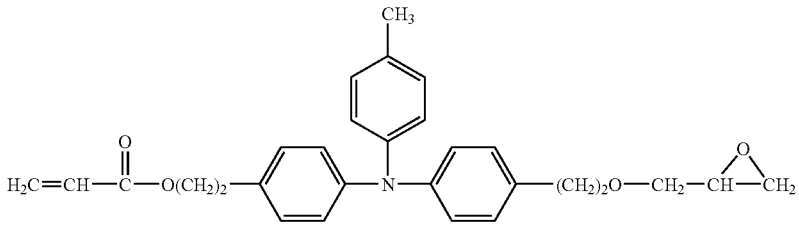 |
| 118 | 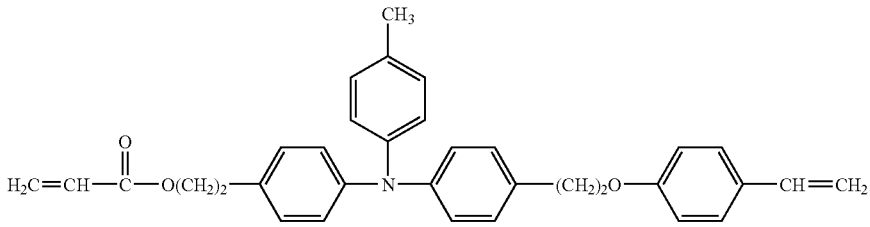 |
| 119 | 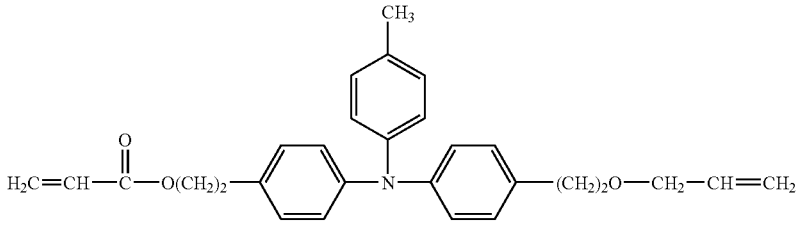 |

A substrate for the photosensitive member can be any conductive substrate, for example a drum or a sheet of a metal or an alloy such as aluminum, copper, chromium, nickel, zinc or stainless steel, a plastic film laminated with a metal foil such as of aluminum or copper, a plastic film evaporated with aluminum, indium oxide or tin oxide, or a metal, a plastic film or a paper provided with an electroconductive layer by coating a conductive substance singly or together with a binder resin.

In the invention, an undercoat layer having a barrier function and an adhering function may be provided on the substrate.

The undercoat layer is provided for improving an adhesive property of the photosensitive layer, improving a coating property, protecting the substrate, covering a defect on the substrate, improving a charge injection property from the substrate, and protecting the photosensitive layer from an electrical destruction. As a material for the undercoat layer, there can be employed for example polyvinyl alcohol, poly-N-vinylimidazole, polyethylene oxide, ethyl cellulose, an ethylene-acrylic acid copolymer, casein, polyamide, N-methoxymethylated 6-nylon, copolymerized nylon, glue or gelatin. Such material is dissolved in a respectively suitable solvent and coated on the substrate. There is preferred a film thickness of 0.1 to 2 μm.

A charge generation substance to be employed in the charge generation layer can be, for example, selenium-tellurium, a pyrylium dye, a thiapyrylium dye, a phthalocyanine compound of various center metals and crystal systems such as of α, β, γ, ε or X crystal type, an antanthrone pigment, a dibenzpyrene quinine pigment, a pyranthrone pigment, a trisazo pigment, a disazo pigment, a monoazo pigment, an indigo pigment, a quinacridone pigment, an asymmetric quinocyanine pigment, quinocyanine or amorphous silicon described in Japanese Patent Application Laid-open No. S54-143645.

In case of a photosensitive member having a multi-layer type photosensitive layer, the charge generation layer is formed by well dispersing the aforementioned charge generation substance with a binder resin of 0.3 to 4 times amount and a solvent in a homogenizer, an ultrasonic disperser, a ball mill, a vibrating ball mill, a sand mill, an attriter or a roll mill then coating the obtained dispersion followed by drying, or as a film singly of the aforementioned charge generation substance such as an evaporated film. It preferably has a film thickness of 5 μm or less, particularly preferably within a range of 0.1 to 2 μm.

The binder resin can be a polymer or a copolymer of a vinyl compound such as styrene, vinyl acetate, vinyl chloride, an acrylate ester, a methacrylate ester, vinylidene fluoride, or trifluoroethylene; polyvinyl alcohol, polyvinyl acetal, polycarbonate, polyester, polysulfone, polyphenylene oxide, polyurethane, cellulose resin, phenolic resin, melamine resin, silicone resin or epoxy resin.

The positive hole transporting compound having the unsaturated polymerizable functional group in the invention may be employed as a charge transport layer on the aforementioned charge generation layer, or as a surface layer after forming a charge transport layer constituted of a charge transport substance and a binder resin on a charge generation layer.

In case the photosensitive member has a surface layer, a charge transport layer provided under the surface layer can be formed by coating and drying, by the aforementioned known method, a solution prepared by dispersing or dissolving in a solvent a suitable charge transport substance, for example a polymer compound having a heterocyclic ring or condensed polycyclic aromatic structure such as poly-N-vinylcarbazole or polystyrylanthracene, or a low-molecular compound for example a heterocyclic compound such as pyrazoline, imidazole, oxazole, triazole or carbazole, a tri-arylamine compound such as triphenylamine, a phenylene-diamine derivative, an N-phenylcarbazole derivative, a stilbene derivative, or a hydrazone derivative, together with a suitable binder resin (selectable from aforementioned ones for the charge generation layer). In such case, a ratio of the charge transport substance and the binder resin is suitably selected in such a manner that, taking the total weight of both as 100, the charge transport substance comes to a weight of 30 to 100 and more preferably 50 to 100. An amount of the charge transport substance less than this range reduces the charge transporting ability, leading to drawbacks such as a lowered sensitivity and an increased residual potential. Also in such configuration, the photosensitive layer has a thickness within a range of 5 to 30 μm, and in this case, the thickness of the photosensitive layer is a sum of thicknesses of the charge generation layer, the charge transport layer and the surface layer.

The surface layer can be formed by the method described above.

Also the surface layer may contain conductive particles. The conductive particles can be a metal, a metal oxide or carbon black. The metal can be aluminum, zinc, copper, chromium, nickel, stainless steel or silver, or such metal evaporated on the surface of plastic particles. Also the metal oxide can be zinc oxide, titanium oxide, tin oxide, antimony oxide, indium oxide, bismuth oxide, tin-doped indium oxide, antimony-doped tin oxide or antimony-doped zirconium oxide. These may be employed singly or in a combination of two or more kinds. In case of combining two or more kinds, they may be a mere mixture, a solid solution or a fused substance.

The conductive particles to be employed in the invention preferably has an average particle size of 0.3 μm or less in consideration of transparency of the protective layer, more preferably 0.1 μm or less.

In the invention, among the aforementioned conductive particles, a metal oxide is particularly preferable in consideration of transparency and the like.

A proportion of the conductive metal oxide particles in the surface layer is one of factors directly determining the resistance of the surface layer, which is preferably within a range of $10^{10}$ to $10^{15}$ Ω·cm.

The surface layer of the invention may contain particles of a resin containing fluorine atoms.

The particles of the fluorine atom-containing resin is preferably one or more selected suitably from tetrafluoroethylene resin, trifluorochloroethylene resin, hexafluoroethylenepropylene resin, vinyl fluoride resin, vinylidene fluoride resin, difluorodichloroethylene resin and copolymers of these, and tetrafluoroethylene resin and vinylidene fluoride resin are particularly preferable. A molecular weight and a particle size of the resin particles can be suitably selected and are not particularly restricted.

A proportion of the fluorine atom-containing resin in the surface layer is preferably 5 to 70% by weight with respect to the total weight of the surface layer, more preferably 10 to 60% by weight. A proportion of the fluorine atom-containing resin exceeding 70% by weight tends to reduce a mechanical strength of the surface layer, and a proportion less than 5% by weight may result in an insufficiency in a surface releasing property, an abrasion resistance and a scratch resistance of the surface layer.

In the invention, for the purpose of improving a dispersion property, an adhesive property and a weather resistance, additives such as a radical scavenger and an antioxidant may be added in the surface layer.

The surface layer employed in the invention preferably has a thickness within a range of 0.2 to 10.0 μm, more preferably 0.5 to 6.0 μm.

(Developer)

A developer to be employed in the invention may be a one-component developer constituted solely of a toner, or a two-component developer constituted of a toner and a carrier. In the invention, the toner contains at least toner particles and inorganic fine particles. A colorant to be used in the toner particles can be any dye or pigment conventionally employed in a known toner. The toner particles of the invention are not particularly restricted in the producing method, and can be formed for example by suspension polymerization, emulsion polymerization, association polymerization or kneading-crushing.

In the following, there will be explained a method for producing toner particles by a suspension polymerization method. In a polymerizable monomer, a colorant, and if desired, other additives such as a material having a low softening point such as a wax, a polar resin, a charge controlling agent and a polymerization initiator are added and uniformly dissolved or dispersed by a homogenizer or an ultrasonic disperser to obtain a monomer composition, which is then dispersed in an aqueous phase containing a dispersion stabilizer by an agitator, a homogenizer or a homomixer. In this operation, particles are formed under a regulation of an agitating speed and a time in such a manner that liquid droplets of the monomer composition have a size of desired toner particles. Thereafter, an agitation may be conducted at such a level that the particulate state of the monomer composition is maintained and the precipitation of the particles of the monomer composition is prevented by the function of the dispersion stabilizer. The polymerization may be conducted at a temperature of 40° C. or higher, generally within a range of 50 to 90° C. A temperature increase may be executed at a latter stage of the polymerization, and a part of water or a part of aqueous medium may be distilled off in a latter stage of or after the reaction in order to eliminate unreacted polymerizable monomers and by-products that constitute a cause of an odor at the toner fixation. After the reaction, the generated toner particles are recovered by rinsing and filtration, and dried. In the suspension polymerization, it is preferable to employ 300 to 3,000 parts by weight of water as a dispersion medium, based on 100 parts by weight of the monomer composition.

A particle size distribution and a particle size of the toner particles can be controlled by a pH regulation of the aqueous medium during the particle formation, a method of varying a kind and an amount of a sparingly water-soluble inorganic salt and a dispersant serving as a protective colloid, or a control of a peripheral speed of a rotor of a mechanical apparatus, a number of passes, a shape of agitating blades, an agitating condition, a shape of a container or a concentration of solid content in an aqueous solution.

A polymerizable monomer to be employed in the suspension polymerization can be, for example, styrene; a styrene derivative such as o- (m-, p-) methylstyrene, or m-(p-) ethylstyrene; a (meth)acrylate ester such as methyl (meth) acrylate, propyl (meth)acrylate, butyl (meth)acrylate, octyl (meth)acrylate, dodecyl (meth)acrylate, stearyl (meth)acrylate, behenyl (meth)acrylate, 2-ethylhexyl (meth)acrylate, dimethylaminoethyl (meth)acrylate, or diethylaminoethyl (meth)acrylate; butadiene, isoprene, cyclohexene, (meth) acrylonitrile or acrylamide.

A polar resin to be added at the polymerization is preferably a styrene-(meth)acrylic acid copolymer, a maleic acid copolymer, a polyester resin or an epoxy resin.

A substance of low softening point to be employed in the invention can be paraffin wax, polyolefin wax, Fischer-Tropsch wax, amide wax, a higher fatty acid, ester wax, a derivative thereof or a graft/block copolymer thereof.

A charge controlling agent to be employed in the invention can be any known material, but is preferably a charge controlling agent which does not inhibit polymerization and does not contain a soluble component in the aqueous medium. Specific examples of such agent include, as negative type, salicylic acid, naphthoic acid, a dicarboxylic acid, a metal derivative thereof, a polymer compound having sulfonic acid in a side chain, a boron compound, an urea compound, a silicon compound, and carixarene; and as positive type, a quaternary ammonium salt, a polymer compound having a quaternary ammonium salt in a side chain, a guanidine compound, and an imidazole compound. Such charge controlling agent is preferably employed in an amount of 0.2 to 10 parts by weight based on 100 parts by weight of the polymerizable monomer.

A polymerization initiator to be employed in the invention can be an azo-type polymerization initiator such as 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile or azobisisobutylonitrile, or a peroxide polymerization initiator such as benzoyl peroxide, methyl ethyl ketone peroxide, disopropyl peroxycarbonate, cumene hydroxyperoxide, 2,4-dichlorobenzoyl peroxide or lauroyl peroxide. Such polymerization initiator is employed in an amount variable depending on a desired polymerization degree, but is generally used in 0.5 to 20% by weight based on the polymerizable monomer. The polymerization initiator to be employed is variable depending on the polymerization process, and is employed singly or in a mixture based on a 10-hour half period temperature.

A dispersant for the suspension polymerization can be an inorganic oxide such as calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, a magnetic material or ferrite, or an organic compound such as polyvinyl alcohol, gelatin, methyl cellulose, methylhydroxypropyl cellulose, ethyl cellulose, sodium salt of carboxymethyl cellulose or starch. Such dispersant is preferably employed in an amount of 0.2 to 2.0 parts by weight based on 100 parts by weight of the polymerizable monomer.

The dispersant may be a commercially available one, but dispersant particles of uniform fine granularity can be obtained by generating an inorganic compound in a dispersion medium under a high-speed agitation. For example, in case of calcium phosphate, a dispersant suitable for the suspension polymerization can be obtained by mixing an aqueous solution of sodium phosphate and an aqueous solution of calcium chloride under high-speed agitation.

For obtaining finer dispersant, a surfactant may be added in an amount of 0.001 to 0.1 parts by weight based on 100 parts by weight of the suspension. There can be employed a commercially available nonionic, anionic or cationic surfactant, such as sodium dodecylsulfate, sodium tetradecylsulfate, sodium pentadecylsulfate, sodium octylsulfate, sodium oleate, sodium laurate, potassium stearate or calcium oleate.

In the following there will be explained a method for producing toner particles by a kneading-crushing method. A binder resin to be employed in the kneading-crushing method can be polystyrene, poly-α-methylstyrene, a styrene-propylene copolymer, a styrene-butadiene copolymer, a styrene-vinyl chloride copolymer, a styrene-vinyl acetate copolymer, a styrene-acrylate ester copolymer, a styrene-methacrylate ester copolymer, vinyl chloride resin, polyester resin, epoxy resin, phenolic resin, or polyurethane resin. These can be employed singly or in a mixture. Among these, a styrene-acrylate ester copolymer resin, a styrene-methacrylate ester copolymer resin or a polyester resin is particularly preferred.

In case of controlling the toner particles to be positively chargeable, there is added a product denatured by a fatty acid metal salt; a quaternary ammonium salt such as tributylbenzidylammonium-1-hydroxy-4-naphthosulfonate salt or tetrabutylammonium tetrafluoroborate; a phosphonium salt such as tributylbenzylphosphonium-1-hydroxy-4-naphthosulfonate salt or tetrabutylphosphonium tetrafluoroborate; an amine or polyamine compound; a metal salt of a higher fatty acid; an acetylacetone metal complex; a diorganotin oxide such as dibutyl tin oxide, dioctyl tin oxide or dicyclohexyl tin oxide; or a diorganotin borate such as dibutyl tin borate, dioctyl tin borate or dicyclohexyl tin borate. In case of controlling the toner particles to be negatively chargeable, an organometallic complex or a chelate compound is effective, and there can be employed a monoazo metal complex, an acetylacetone metal complex, or a metal complex of an aromatic hydroxycarboxylic acid or an aromatic dicarboxylic acid. Such charge controlling agent is employed in an amount of 0.1 to 15 parts by weight, preferably 0.1 to 10 parts by weight based on 100 parts by weight of the binder resin.

A substance of a low softening point may be added to the toner particles if necessary. The low-softening point substance can be an aliphatic hydrocarbon wax such as low-molecular polyethylene, low-molecular polypropylene, paraffin wax, or Fischer-Tropsch wax, or an oxide thereof; a wax principally constituted of an aliphatic ester such as carnauba wax or montanate ester wax, or a partial or total deoxidized product thereof; a saturated linear aliphatic acid such as palmitic acid, stearic acid or montanic acid; an unsaturated fatty acid such as brassidic acid, eleostearic acid or parinaric acid; a saturated alcohol such as stearyl alcohol, aralkyl alcohol, behenyl alcohol, carnaubyl alcohol, ceryl alcohol, or melissyl alcohol; a polyhydric alcohol such as sorbitol; a fatty acid amide such as linolamide; a saturated fatty acid bisamide such as methylenebisstearylamide; an unsaturated fatty acid amide such as ethylenebisoleylamide; an aromatic bisamide such as N,N'-distearylisophthalamide; a fatty acid metal salt such as zinc stearate; a wax formed by grafting a vinylic monomer such as styrene to an aliphatic hydrocarbon wax; a partially esterified product of a fatty acid and a polyhydric acid such as behenyl monoglyceride; or a methyl esterified product having a hydroxyl group obtained by a hydrogenation of a vegetable oil. An amount of the low-softening point substance is 0.1 to 20 parts by weight, preferably 0.5 to 10 parts by weight, based on 100 parts by weight of the binder resin.

Then a binder resin, a releasing agent, a charge control agent, a colorant and the like are sufficiently mixed by a mixer such as a Henshel mixer or a ball mill, and fused and kneaded by a thermal kneader such as heated rolls, a kneader or an extruder to disperse or dissolve the charge control agent and the colorant in the mutually dissolved resins. After solidification by cooling, a mechanical crushing is executed to achieve a desired particle size, and a classification is executed to sharpen a particle size distribution of the crushed product. Otherwise, after solidification by cooling, a fine crushed product obtained by a collision to a target in an air jet stream is made spherical by heat or by a mechanical impact force.

In the invention, in order to improve a developing property or a durability, there may be added, to the toner, fine inorganic particles of a metal oxide such as of silicon, magnesium, zinc, aluminum, titanium, cerium, cobalt, iron, zirconium, chromium, manganese, tin, or antimony; a metal salt such as barium sulfate, calcium carbonate, magnesium carbonate or aluminum carbonate; a clay mineral such as caolin; a phosphate compound such as apatite; a silicon compound such as silicon carbide or silicon nitride; carbon powder such as carbon black or graphite.

Also for a similar purpose, there may be added organic particles or composite particles for example resin particles such as polyamide resin particles, silicone resin particles, silicone rubber particles, urethane particles, melamine-formaldehyde particles or acrylic particles; composite particles formed from rubber, wax, a fatty acid compound or a resin and inorganic particles of a metal, a metal oxide or carbon black; a fluorinated resin such as Teflon (registered trade name) or polyvinylidene fluoride; a fluorine compound such as carbon fluoride; a fatty acid metal salt such as zinc stearate; a fatty acid derivative such as a fatty acid ester; molybdenum sulfide, an amino acid or an amino acid derivative.

A developer employed in the image forming method of the present embodiment is a two-component developer formed by a mixture of a non-magnetic polymerization toner formed by suspension polymerization and a resinous magnetic carrier. The developer has a toner-carrier ratio (T/D ratio; a weight ratio of toner in a two-component developer) of 8%, and the resinous magnetic carrier has a magnetization of 100 emu/cm$^3$ in a magnetic field of 1 kilooersted, a number-averaged particle size of 40 μm and a specific resistivity of $10^{13}$ Ω·cm.

In general, a polymerization toner has a higher sphericity in comparison with a pulverization toner. A sphericity of the shape of the toner particles is represented by shape factors SF-1 and SF-2 calculated from the following equations (3). The shape factors SF-1 and SF-2 are obtained by random sampling 100 toner images with a FE-SEM S-800 manufactured by Hitachi Ltd., then analyzing the image information by an image analyzing apparatus Luzex 3, manufactured by Nireco Corp., and executing calculation according to the following equations (3):

$$SF-1 = \frac{(MXLNG)^2}{\text{AREA}} \times \frac{\pi}{4} \times 100 \qquad (3)$$

$$SF-2 = \frac{(PERI)^2}{\text{AREA}} \times \frac{1}{4\pi} \times 100$$

(AREA: projected area of toner particle, MXLNG: absolute maximum length, PERI: peripheral length).

Among the toner shape factors, SF-1 indicates a sphericity, and the toner is a true sphere when SF-1 is 100, is approximately spherical when SF-1 is 100 to 140, and becomes from approximately spherical to gradually amorphous when SF-1 is larger than 140. Also SF-2 indicates an irregularity on the surface of the toner particle, and the toner surface is smooth when SF-2 is 100 to 120 and shows an evident irregularity when SF-2 is larger than 120. The polymerization toner to be employed in the image forming method of the present embodiment is, for maintaining a high transfer efficiency, preferably an approximately spherical toner with an average particle size of 6 to 10 μm, a shape factor SF-1 of 100 to 140 and a shape factor SF-2 of 100 to 120.

The toner employed in the present embodiment is produced by a polymerization process, and silica or titanium oxide with a particle size of 20 nm is added externally to the toner in order to stabilize a charging property against an environmental change and to improve a flowability.

In the present embodiment, there has been described a spherical toner having satisfactory transfer property prepared by a polymerization process, but the present invention is not limited to such toner and there can also be employed a toner prepared by a conventional mechanical pulverization and classification and made spherical by a thermal or mechanical post-treatment.

(Abrasive Particles)

In the following, there will be explained abrasive particles to be employed in the invention. The invention employs inorganic fine particles as the abrasive particles. The inorganic fine particles have a high hardness and an excellent abrasive ability. The inorganic fine particles are preferably those selected from the group of strontium titanate, barium titanate and calcium titanate. The abrasive ability is greatly influenced by the particle size of the inorganic fine particles, and the abrasive effect becomes larger as the particle size is larger. Any particle shape having an excellent abrasive ability can be employed, but there is preferred strontium titanate having a cubic and/or rectangular parallelepiped particle shape and a perovskite crystalline structure. The abrasive particles having a cubic and/or rectangular parallelepiped particle shape and a perovskite crystalline structure can effectively eliminate charging products on the surface of the image bearing member. It is estimated that the cubic and/or rectangular parallelepiped particle shape increases a contact area with the surface of the image bearing member and that edges of the cubic and/or rectangular parallelepiped shape come into contact with the surface of the image bearing member to attain a satisfactory scraping property. The strontium titanate of perovskite crystalline structure to be employed in the present invention preferably has an average particle size of primary particles within a range of 30 to 300 nm, more preferably 30 to 200 nm. An average particle size less than 30 nm may result in an insufficient abrasive effect of the abrasive particles in a cleaner portion, while an average particle size exceeding 300 nm may provide an excessive abrasive effect, eventually leading to scratches on the surface of the photosensitive member or damages on the contact charging roller.

The abrasive particles can be supplied by a development using a toner which is prepared by externally adding the inorganic fine particles of perovskite crystalline structure to the toner particles obtained as described above. An amount of the inorganic fine particles of perovskite crystalline structure added to the toner particles is preferably 0.05 to 2.00 parts by weight, more preferably 0.20 to 1.80 parts by weight, based on 100 parts by weight of the toner particles. Also in case of externally adding the inorganic fine particles of perovskite crystalline structure subjected to a surface treatment with a fatty acid having 8 to 35 carbon atoms or a metal salt thereof, the amount of addition is preferably 0.05 to 3.00 parts by weight, more preferably 0.20 to 2.50 parts by weight based on 100 parts by weight of the toner particles.

Silica and titanium oxide employed as an external additive to the aforementioned developer are also inorganic fine particles, but do not exhibit an effective abrasive effect to the photosensitive member with high durability of the invention, because of their particle size as small as 20 nm and of their spherical shape or polyhedral shape close to a sphere.

(Cleaning Apparatus)

Figure 3:
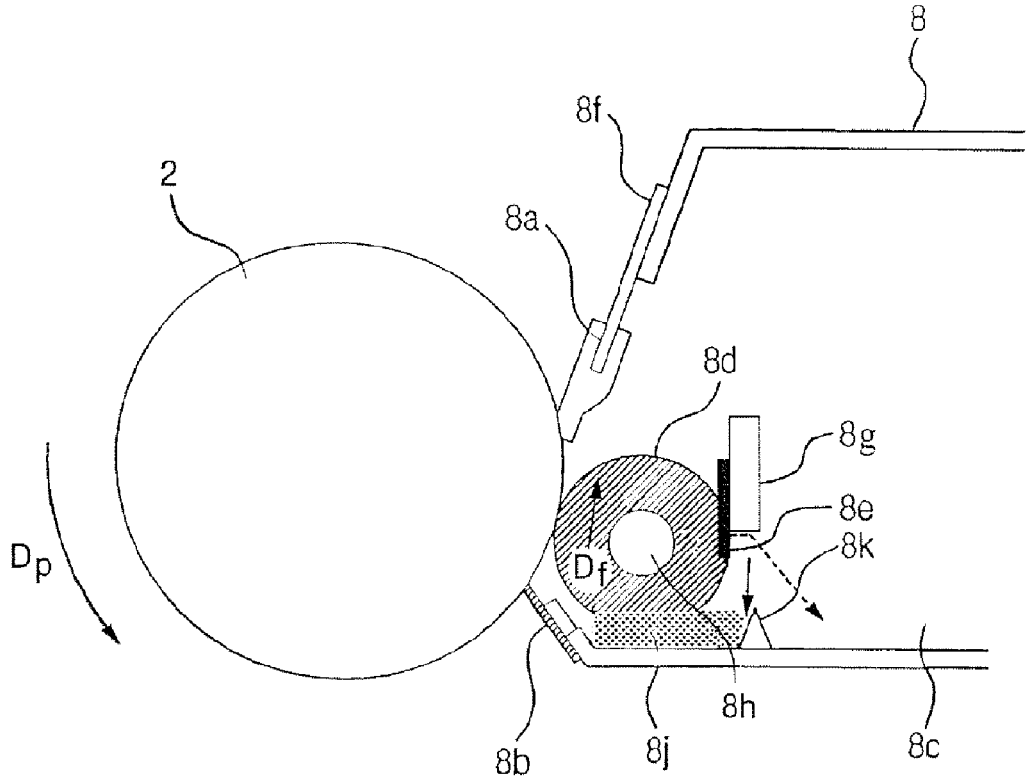
FIG. 3 is a schematic cross-sectional view of a cleaning apparatus in Examples 1, 3 of the invention.
Figure 4:
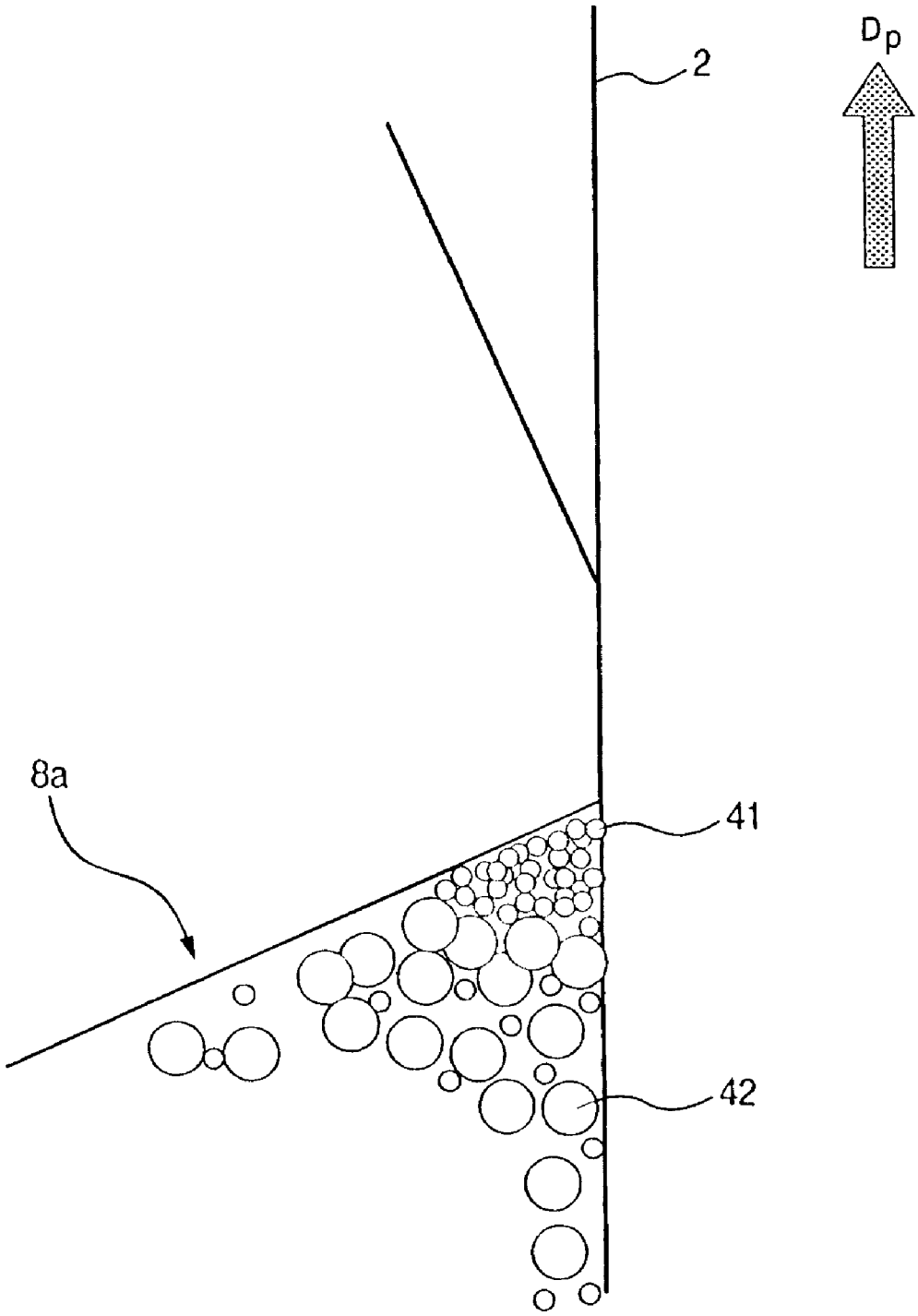
FIG. 4 is an enlarged view showing a vicinity of a cleaning blade edge.
Figure 5:
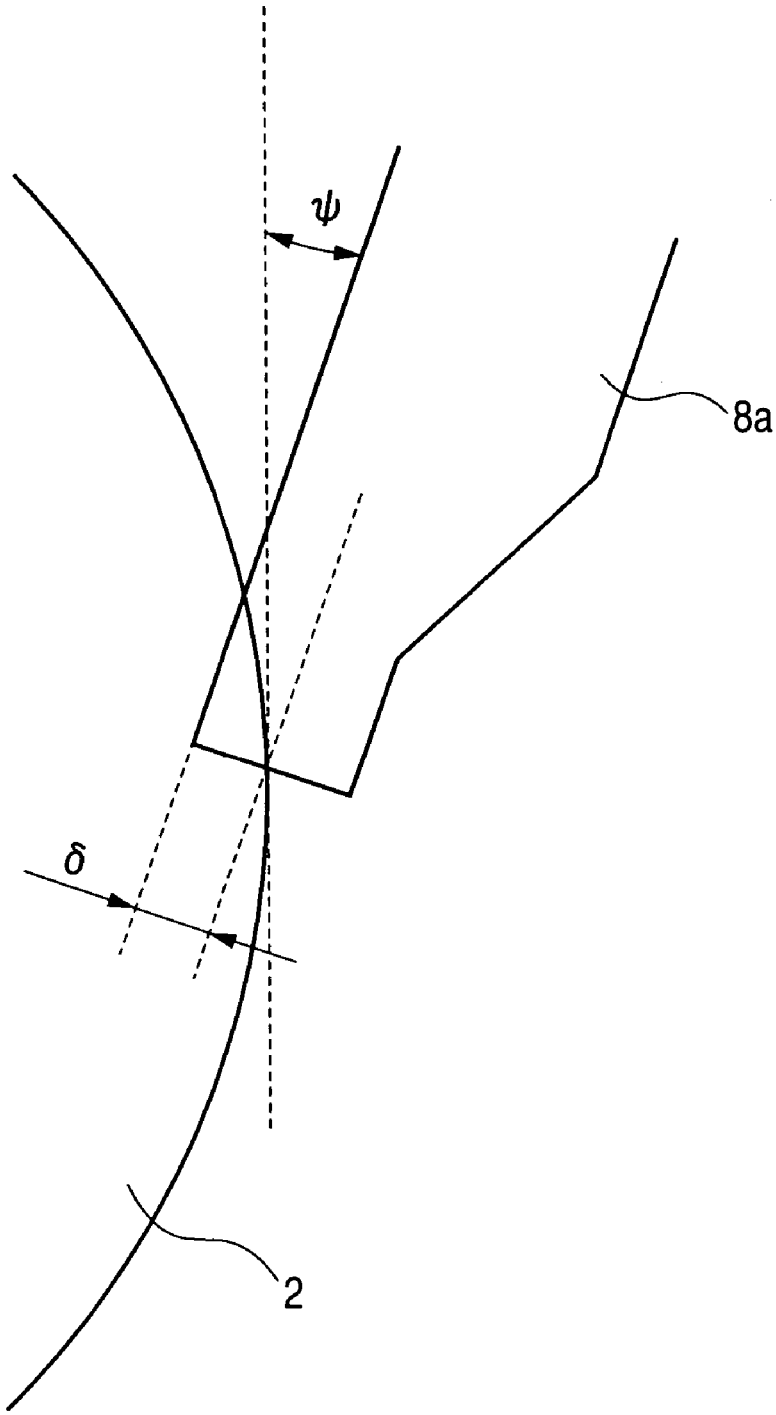
FIG. 5 is a schematic view showing a configuration of a cleaning blade and a photosensitive member.

In the following there will be given an explanation on the cleaning apparatus. FIGS. 3, 4 and 5 illustrate a cleaning blade. A cleaning blade 8*a* is formed of a polyurethane rubber integrally supported on an end portion of a metal plate 8*f*, and is brought into contact with the photosensitive member 2 under a specified penetration level δ and a set angle ψ. In the present invention, the cleaning blade preferably has a rubber hardness of 50 to 85° (JIS A), more preferably 60 to 80° (JIS A). The present embodiment employs a cleaning blade of an urethane rubber of a hardness of 70° (JIS A), with conditions of ψ=22° and δ within a range of 0.5 to 1.3 mm, and with a contact pressure B of the cleaning blade to the photosensitive member 2 within a range of 10 to 50 g/cm. The contact pressure B of the cleaning blade to the photosensitive member 2 is preferably within a range of 10 to 50 g/cm. A contact pressure of the cleaning blade less than 10 g/cm tends to cause a cleaning failure by a toner passing through under the blade, and a pressure exceeding 50 g/cm cannot provide a sufficient durability because of a blade chipping.

In the invention, the abrasive particles are present in a contact portion between the cleaning blade and the image bearing member. The abrasive particles can be supplied to the contact portion for example by a development with toner particles externally added with the abrasive particles, or by a separate supply of the abrasive particles by means of a supply member. In case of supply of the abrasive particles by an external addition to the toner particles, the external addition is made in such a manner that the abrasive particles are mixed, for example in a ratio of 5% by weight with a transfer residual toner remaining on the surface of the photosensitive member after the transfer of the toner image onto the recording medium. More specifically, as the amount of the transfer residual toner varies according to a density of a formed image, a ratio of the aforementioned external addition is so selected that the abrasive particles are mixed in a desired ratio with the transfer residual toner, based on an average amount of the transfer residual toner generated in case of forming an image of a density of about 5 to 20%, which is usually often used as an image density. For example, there can be employed a method of regulating the amount of the externally added abrasive particles in such a manner, in case of making 100 images with a density of about 5 to 20%, that the abrasive particles are present in a ratio of 5% by weight in the waste toner once recovered by the cleaning apparatus.

As the toner particles are more selectively transferred onto the recording medium in the transfer step, the mixing ratio of the abrasive particles increases relatively in the transfer residual toner. Thus a mixing ratio of the abrasive particles in the transfer residual toner is significantly higher than that in the toner to be used in the development. It is therefore desirable to regulate in advance the ratio of the abrasive particles externally added to the toner, in such a manner that the abrasive particles represent a desired ratio in the waste toner under an image forming condition of a frequently employed image density.

On the other hand, in an image forming apparatus in which an average density of formed images significantly exceeds the aforementioned density of 20%, the external addition amount of the abrasive particles may be increased according to such average density. Contrary to this, in an image forming apparatus in which an average density of formed images is significantly lower than the aforementioned density of 5%, the external addition amount of the abrasive particles may be decreased, but the aforementioned standard amount for the density of about 5 to 20% may naturally be employed without any difficulty.

In setting the addition amount of the abrasive particles, the ratio of the abrasive particles added to the transfer residual toner can be determined by a method, based on a fluorescent X-ray specific to the inorganic fine particles used for the abrasive particles, of preparing a calibration line by an intensity of the fluorescent X-ray per a unit weight of a standard sample with a known mixing ratio of the toner and the abrasive particles thereby determining the mixing ratio of the actual abrasive particles in the actual transfer residual toner.

On the other hand, in case of supplying the abrasive particles directly to the surface of the photosensitive member by means of an abrasive particle supplying apparatus instead of external addition to the toner particles, such supply may be executed in any position after the transfer portion and before the contact portion of the photosensitive member with the cleaning blade 8*a*. For example, as shown in FIG. 3, a rotating fur brush 8*d* may be provided immediately before the contact portion of the photosensitive member with the cleaning blade 8*a* to supply the abrasive particles.

Also there may be adopted a configuration of externally adding a part of the abrasive particles to the toner particles and providing an abrasive particle supplying apparatus behind the transfer portion for a complementary direct supply of the abrasive particles onto the surface of the photosensitive member. In such case, the respective amounts of addition may be so selected that the abrasive particles, as a sum of those externally added in advance to the developing toner and those supplied in a constant rate from the abrasive particle supplying apparatus, are mixed at a desired ratio in the transfer residual toner.

When an edge of the cleaning blade is contacted in a counter direction to the moving direction of the surface of the photosensitive member, a wedge-shaped space thus formed generally accumulates particles 41 of a smaller particle size and a lower adhesive power, such as silica, titanium oxide or abrasive particles employed in the invention, thereby preventing a phenomenon that the toner particles 42 enter such wedge-shaped space and pass through under the blade.

FIG. 4 schematically illustrates a contact state of an edge of the cleaning blade 8*a* to the surface of the photosensitive member, in the cleaning apparatus 8 employed in the image forming method of the invention. The edge contacted from a counter direction to the moving direction Df of the surface of the photosensitive member forms a wedge-shaped space, in which particles of smaller diameters, such as silica, titanium oxide and abrasive particles are accumulated in a classified state.

(Charging)

Figure 2:
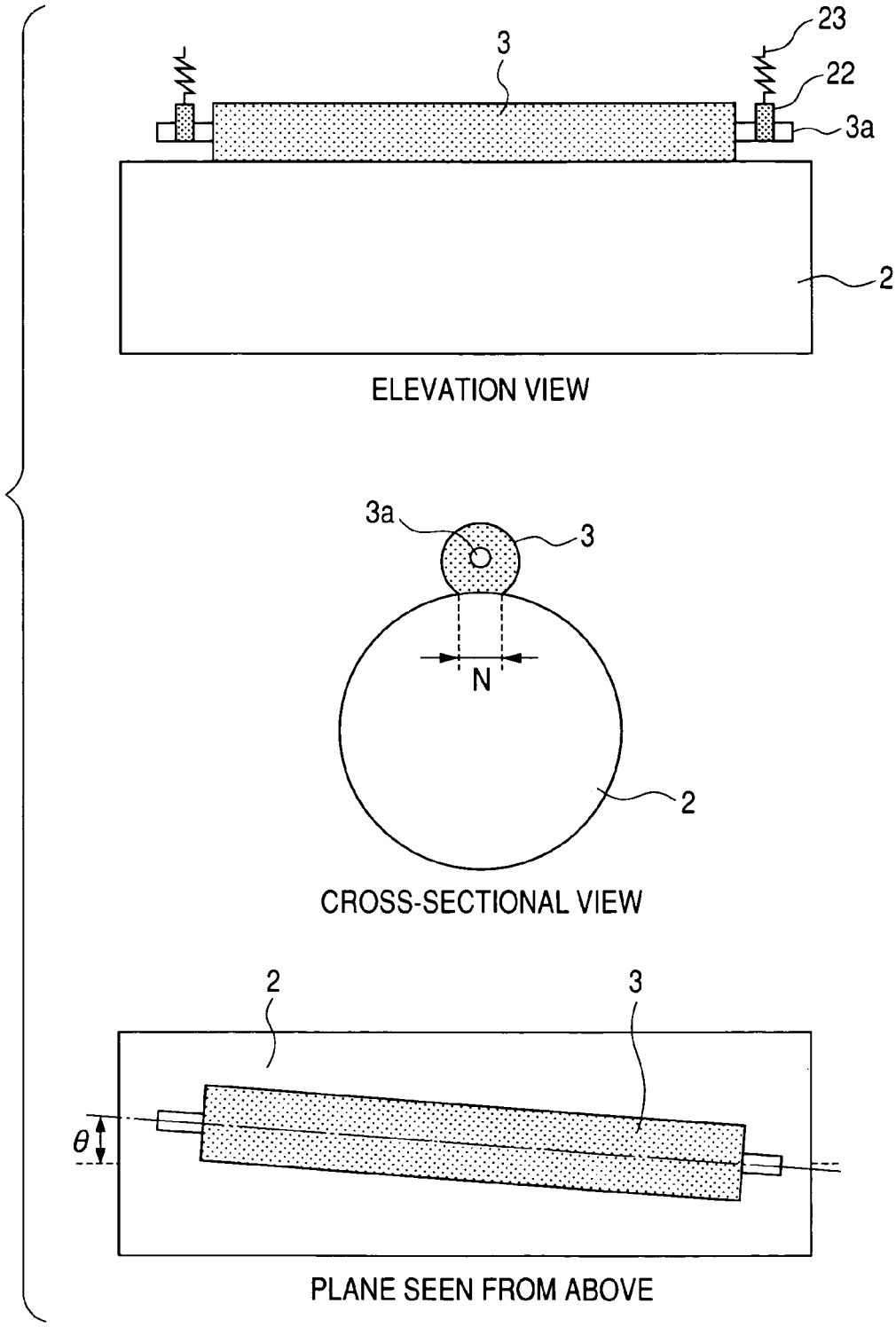
FIG. 2 is a schematic view of a contact charging roller and a photosensitive member to be employed in the present invention.

FIG. 2 shows a charging member and a photosensitive member in an elevation view, a cross-sectional view and a plan view seen from above.

A contact charging roller 3, as a flexible contact charging member serving as a charging member of the present embodiment, is prepared by forming a medium resistance layer of a rubber or a foamed member on a metal core.

The medium resistance layer was constituted of a resin (urethane resin in the present embodiment), conductive particles (such as carbon black), a vulcanizer, a foaming agent etc. and formed in a roller shape on the metal core, followed by a surface polishing.

It is important that the contact charging roller 3, constituting the charging member, can function as an electrode. It is thus necessary to have an elasticity for attaining a sufficient contact state with the photosensitive member and to have a sufficiently low electrical resistance for charging the moving photosensitive member. On the other hand, it is necessary to avoid a voltage leak in case the photosensitive member has a defect of a low voltage resistance such as a pinhole. For obtaining a sufficient charging property and a leak resistance, the contact charging roller preferably has a resistance of $10^4$ to $10^7$ Ω. The present embodiment employs a contact charging roller with a resistance of $10^6$ Ω. The resistance of the contact charging roller 3 was measured by replacing the photosensitive member 2 of the printer with an aluminum drum, then applying a voltage of 100 V between the aluminum drum and the metal core 3*a* of the contact charging roller 3 and measuring a current flowing therebetween. The resistance measurement was conducted in an environment of a temperature of 25° C. and a humidity of 60%.

The contact charging roller 3 preferably has an Asker C hardness of 20 to 60°, since an excessively low hardness deteriorates the contact with the photosensitive member because of an unstable shape, while an excessively high hardness is not only unable to secure a charging nip N with the photosensitive member but also deteriorates microscopic contacts with the surface thereof. The present embodiment employs a hardness of 40°.

A material constituting the contact charging roller 3 is not limited to a foamed elastic member, but can also be a rubber material such as EPDM, urethane, NBR, silicone rubber or IR in which a conductive material such as carbon black or metal oxide is dispersed for resistance regulation, or a foamed material thereof. Also a resistance regulation is possible by means of an ionic conductive material, instead of dispersing a conductive material.

The contact charging roller 3 is supported, by the metal core 3*a* at the longitudinal ends thereof, by bearings 22 in a relationship to the photosensitive member 2 as shown in FIG. 2, and is pressed to the surface of the photosensitive member 2 by pressing springs 23, serving as pressing members associated with the bearings 22. The contact charging roller 3 has a contact pressure to the surface of the photosensitive member 2 preferably of 50 g/cm or less. In case the contact pressure exceeds 50 g/cm, the abrasive particles supplied in the invention pass through under the cleaning blade and cause a friction between the contact charging roller and the photosensitive member, thus inducing a damage on the contact charging roller or the photosensitive member. On the other hand, a lower limit of the contact pressure is determined by a charging property. An excessively low contact pressure renders the contact nip between the photosensitive member 2 and the contact charging roller 3 unstable, whereby a stable discharge becomes difficult. The present embodiment employs a contact pressure of 30 g/cm of the contact charging roller 3 to the surface of the photosensitive member 2. Such setting secures a contact width n (nip width) of 2 mm or larger between the photosensitive member 2 and the contact charging roller 3 even when a crossing angle is provided therebetween as in the present invention, thereby providing a stable charging property. The contact pressure is represented by a linear pressure per unit length in the longitudinal direction of the contact charging roller 3, as such linear pressure is more appropriate than a pressure per unit area, for the ease of measurement, since the contact area is very small in case the contact width is as small as 3 mm or less.

The contact pressure is measured by inserting two stainless steel plates with a width of 1 cm to the contact nip between the photosensitive member 2 and the contact charging roller 3 and measuring, with a spring balance, a force required to extract such plates. The contact charging roller 3 is rotated by the rotation of the photosensitive member 2.

In the invention, the rotary axis of the contact charging roller 3 is given a crossing angle of θ° with respect to the rotary axis of the photosensitive member as shown in FIG. 2. Such crossing angle in the invention is provided, as disclosed in Japanese Patent No. 02745726, to diffuse a contamination of the contact charging roller by the external additives or the like thereby avoiding a localized charging failure. Also, the abrasive particles are supplied to the cleaning blade in the invention, and the crossing angle is provided for avoiding a contamination of the contact charging roller by such abrasive particles and a damage on the contact charging roller or the photosensitive drum by a local contamination.

The contact charging roller is rotated by the rotation of the photosensitive member. The contact charging roller is given a constant current of a frequency of 1.8 kHz and a total current of 2,000 μA from a charging high voltage source, and a potential of the photosensitive member is determined by a superposed DC bias.

EXAMPLES

In the following the present invention will be further clarified with reference to examples, but the present invention is not limited to such examples.

Example 1

An image forming apparatus employed in the present example is approximately same as that in the foregoing embodiment. As the abrasive particles, strontium titanate having an average primary particle size of 100 nm, a cubic and/or rectangular parallelepiped shape and a perovskite crystalline structure was employed. In the abrasive particles, a content of particles or aggregates of a size of 600 nm or larger was 1% in number or less. In the abrasive particles of the present example, the cubic and/or rectangular parallelepiped shape and the perovskite crystalline structure allow to effectively eliminate charging products on the surface of the photosensitive member. Also a supply member for the abrasive particles was provided in the cleaning container, as illustrated in FIG. 3. The cleaning apparatus 8 is constituted of a cleaning blade 8*a* serving as cleaning means supported by a metal plate 8*f*, a toner collecting sheet 8*b*, a used toner recovery container 8*c*, a fur brush 8*d* constituting an abrasive particle supplying member, a brush scraper 8*e* constituting a scraping member, a partition 8*k*, and abrasive particles 8*j*. The abrasive particles 8*j* be in a powder state or in a state once fused and solidified. The fur brush is rotated so as to move in the same direction shown by arrow Df as the photosensitive drum in the contact portion therewith. A supply amount of the abrasive particles can be regulated for example by varying a rotating speed of the fur brush and a density of fibers of the fur brush.

The fur brush 8*d* of the present example is formed by planting conductive fibers on a base cloth and winding them on a metal core 8*h* of a diameter of 6 mm to form a brush of a diameter of 16 mm, wherein the metal core 8*h* is grounded. The fibers can be formed by various materials such as nylon, rayon, polyester or acrylic fiber, and, in the present example, a conductive nylon fiber of a thickness of 0.7 Tex was planted with a fiber density of 93 fiber/mm$^2$ on a base cloth to form a sheet, which was wound spirally on the metal core 8*h* so as to secure an electrical conduction therewith.

A supply amount of the abrasive particles was regulated by varying the rotation speed of the fur brush 8*d*.

The fur brush 8*d*, when operated for a long time, shows a loss in the abrasive particle supply ability because of a clogging of the brush fibers. In order to prevent such phenomenon, a brush scraper 8*e* is provided as a member for scraping off toner and the like accumulated on the brush fibers. In the present example, the brush scraper 8*e* was formed by adhering a flexible PET sheet of a thickness of 0.1 mm on the metal plate 8*g* with a free length of 2 mm and was set with a penetration level β of 1.0 mm relative to the fur brush.

In the used toner accumulated in the cleaning apparatus, an amount (mixing ratio) of the strontium titanate contained therein was measured by a fluorescent X-ray analysis described before.

As to the drum characteristics, a higher HU indicates a higher hardness and a less surface abrasion. Also a higher elastic deformation ratio We indicates a less surface abrasion. Thus HU×We is an index representing an abrasion resistance of the surface of the photosensitive drum, and a larger value thereof indicates a less abrasion.

In the present invention, a surface of a photosensitive drum of a high durability with such low abrasion amount is polished in the cleaning portion to refresh the photosensitive member deteriorated by charging, thereby avoiding an image smearing or a cleaning failure.

The refreshing effect to the surface of the photosensitive member is achieved by the abrasive particles and the cleaning blade. As already explained before, a vicinity of the edge of the cleaning blade has a configuration as shown in FIG. 4, and a wedge-shape space formed by the blade edge and the surface of the photosensitive member accumulates fine particles of small sizes. An increase in the supply amount of the abrasive particles is assumed to increase the amount of the abrasive particles accumulated in the wedge-shaped space, thereby increasing the abrading power to the surface of the photosensitive member. Also the abrading power is increased by an increase in the contact pressure of the cleaning blade. This is estimated because of an increased frictional force of the blade itself to the photosensitive member and an increased pressing of the abrasive particles, accumulated in the wedge-shaped space, onto the surface of the photosensitive member.

Thus the abrading power on the surface of the photosensitive member is represented by a product A×B of a supply amount A of the abrasive particles (weight % ratio A of the abrasive particles in the transfer residual toner) and a contact pressure B (g/cm) of the cleaning blade.

On the other hand, particles intervene in the contact portion (nip portion) between the cleaning blade and the photosensitive member to maintain lubricating property. In the absence of such intervening particles, a tuck-up of the cleaning blade is induced. Such intervening particles are generated by a gradual intervening of the fine particles accumulated in the wedge-shaped space in the vicinity of the edge. Also an amount of particles passing through under the blade depends on the contact pressure B of the cleaning blade and becomes less at a higher contact pressure. Thus a contamination level of the contact charging roller by the particles passing through under the cleaning blade becomes higher in proportion to A/B.

In case of employing a contact charging roller as the charging member, a pad- or brush-shaped cleaning member is usually provided for maintaining the surface of the roller in a clean state. However, after a prolonged durability running, the roller is smeared in a circumferential streak in a portion where the cleaning member is in an insufficient contact, or where the particles can locally pass through under the cleaning blade. Such smeared portion shows a change in the charging property, because of a change in the surface resistance of the contact charging roller. As the smear on the contact charging roller often appears in a streak shape as described above, it shows a big difference from an unsmeared portion in the vicinity, and is revealed in the image particularly in an intermediate tone such as a halftone. In a full-color image forming apparatus as in the present example, an uneven smear on the contact charging roller is more conspicuously revealed as the intermediate tone represents a larger proportion. Also as the abrasive particles are employed in the invention, a local (streaking) smear induces a damage on the surface of the contact charging roller and that of the photosensitive member. Consequently, the present example provides a crossing angle θ between the contact charging roller and the photosensitive drum thereby diffusing the contaminating substance sticking to the surface of the contact charging roller. In the presence of such crossing angle, the contact charging roller and the photosensitive drum have different vectors of rotating direction, whereby the contaminating substance is diffused at the nip portion. A larger crossing angle θ provides a larger diffusing power, thereby more strongly preventing the local (streaking) smear.

In the aforementioned configuration, experiments on the image smearing and the cleaning property were executed by changing a supply amount A (% by weight) of the abrasive particles, a contact pressure B (g/cm) of the cleaning blade, an crossing angle θ (°) and also by preparing photosensitive members in the above-described process with different values of HU and We as the photosensitive member characteristics.

The photosensitive member was prepared by the following process.

(Photosensitive Member Producing Process A)

An aluminum cylinder having a diameter of 60 mm and a length of 357.5 mm was employed as a conductive substrate, on which a coating liquid constituted of following materials was coated by a dip coating method and thermally cured for 30 minutes at 140° C. to obtain a conductive layer of a thickness of 18 μm:

| | |
|---|---|
| conductive pigment: $SnO_2$ coated barium sulfate | 10 parts |
| resistance regulating pigment: titanium oxide | 2 parts |
| binder resin: phenolic resin | 6 parts |
| leveling agent; silicone oil | 0.001 parts |
| solvent: methanol/methoxypropanol = 0.2/0.8 | 15 parts. |

On this conductive layer, a coating liquid prepared by dissolving 3 parts of N-methoxymethylated nylon and 3 parts of copolymerized nylon in a mixed solvent of 65 parts of methanol and 30 parts of n-butanol was coated by a dip coating method to obtain an intermediate layer of a thickness of 0.7 μm.

Then 4 parts of hydroxygallium phthalocyanine having strong peaks at 7.4° and 28.2° in Bragg's angle (2θ±0.2°) in CuKα X-ray diffractometry, 2 parts of polyvinyl butyral (trade name: S-LEC BX-1, manufactured by Sekisui Chemical Industries Co.) and 80 parts of cyclohexanone were dispersed for 4 hours in a sand mill utilizing glass beads having a diameter of 1 mm, and 80 parts of ethyl acetate were added to obtain a charge generation layer coating liquid. It was coated by dip coating to obtain a charge generation layer having a thickness of 0.2 μm.

Then, 7 parts of a styryl compound represented by the following chemical formula (2) and 10 parts of polycarbonate resin (trade name: IUPILON Z800, manufactured by Mitsubishi Engineering Plastics Co.) were dissolved in a mixed solvent of 105 parts of monochlorobenzene and 35 parts of dichloromethane to obtain a charge transport layer coating liquid, which was used to form a charge transport layer on the charge generation layer. The charge transport layer had a thickness of 10 μm:

(2)

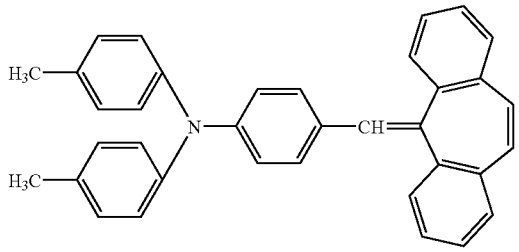

Then 45 parts of a positive hole transporting compound represented by the following chemical formula (3) were dissolved in 55 parts of n-propyl alcohol to obtain a surface layer coating liquid.

(3)

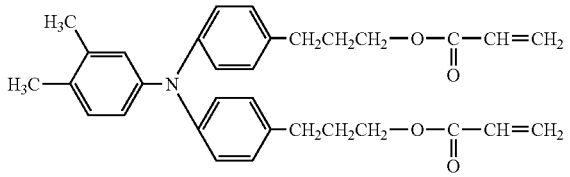

A surface layer was coated with this coating liquid on the charge transport layer, then subjected to an electron beam irradiation under condition of an accelerating voltage of 150 kV and a dose of $1.5\times10^4$ Gy in nitrogen atmosphere, and heated for 3 minutes under a condition that the electrophotographic photosensitive member reached a temperature of 150° C. In this operation, an oxygen concentration was 80 ppm. Subsequently the photosensitive member was post-treated for 1 hour at 140° C. in the air to form a surface layer of a thickness of 5 μm, thereby completing the photosensitive member.

A part of the obtained electrophotographic photosensitive members was subjected, after standing for 24 hours in an environment of 23° C./50% RH, to a hardness measurement in the following manner. The universal hardness HU and the elastic deformation ratio We were measured with a microhardness measuring apparatus Fischer-Scope H100V, manufactured by Fischer Inc., capable of applying a load continuously on an indenter and directly reading an indentation depth under the load thereby determining the hardness in continuous manner. There was employed a Vickers tetragonal cone diamond indenter with a face angle of 136°. The measurement was conducted under stepped loads (273 levels with a holding time of 0.1 seconds at each level) up to a maximum load of 6 mN.

The photosensitive member prepared in this process showed We=57 and HU=185.

(Photosensitive Member Producing Process B)

A photosensitive member was prepared in the same manner as in the photosensitive member producing process A, except that 45 parts of polytetrafluoroethylene fine particles were added and dispersed in the surface layer coating liquid.

The photosensitive member prepared in this process showed We=40 and HU=150.

(Photosensitive Member Producing Process C)

A photosensitive member was prepared in the same manner as in the photosensitive member producing process A, except that, in the surface layer coating liquid, 45 parts of the positive hole transporting compound represented by the general formula (3) were changed to 30 parts, also 15 parts of an acrylic monomer represented by the following general formula (12) are added and 5 parts of polytetrafluoroethylene fine particles were added and dispersed.

The photosensitive member prepared in this (12)

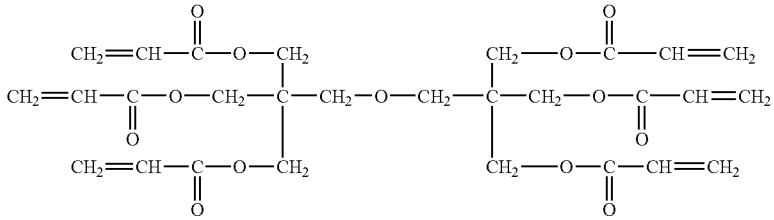

process showed We=65 and HU=220.

As another method for controlling HU and We, a change in the electron beam irradiating condition can also be utilized effectively. For example, smaller values of HU and We can be obtained by selecting an electron beam irradiating condition lower than $1.5\times10^4$ Gy in the aforementioned photosensitive member producing process A. In this manner, photosensitive members with controlled values of Hu and We were prepared.

Figure 6:
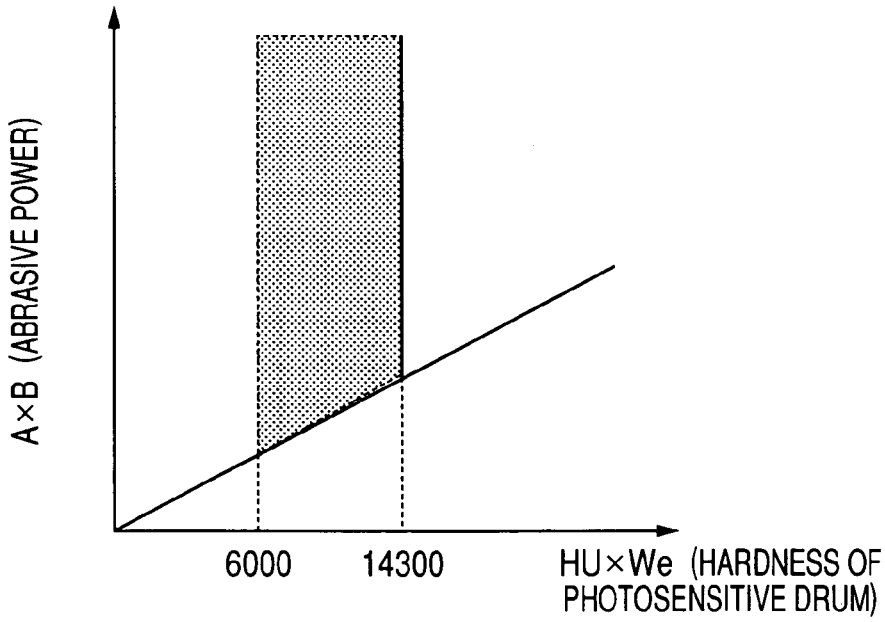
FIG. 6 is a view showing a relationship between A×B and HU×We in Example 1.

FIG. 6 is a graph showing a relationship between A×B and HU×We. A number 6,000 on the abscissa indicates a value where HU×We becomes minimum within a range of 150≦HU≦220 and 40≦We≦65, namely the condition that the photosensitive member is most easily abradable. An amount of abrasion is smaller than that in a prior organic photosensitive member even under such easily abradable condition. Under such condition of HU×We=6,000, an evaluation was made by a durability test of 10,000 prints in an environment of a temperature of 30° C. and a humidity of 80% by varying the abrasive particle supply amount A and the contact pressure B of the cleaning blade. Results are shown in Table 1. In Table 1, + indicates good and − indicates poor.

TABLE 1

(Results of evaluation at HU × We = 6,000)

| A (weight %) | B (g/cm) | Evaluation result |
|---|---|---|
| 0.05 | 20 | + |
| 0.07 | 15 | + |
| 0.10 | 10 | + |
| 0.20 | 10 | + |
| 1.00 | 20 | + |
| 0.04 | 30 | + |
| 0.04 | 20 | − image smearing |
| 0.05 | 15 | − image smearing |
| 0.20 | 9 | − toner pass-through |

Then, at HU×We=14,300 where it becomes maximum within a range of 150≦HU≦220 and 40≦We≦65, namely where the photosensitive member is least abradable, an evaluation was made by a durability test of 10,000 prints in an environment of a temperature of 30° C. and a humidity of 80% by varying the abrasive particle supply amount A and the contact pressure B of the cleaning blade. Results are shown in Table 2. In Table 2, + indicates good and − indicates poor.

TABLE 2

(Results of evaluation at HU × We = 14,300)

| A (weight %) | B (g/cm) | Evaluation result |
|---|---|---|
| 0.05 | 50 | + |
| 0.05 | 45 | − image smearing |
| 0.10 | 25 | + |
| 0.10 | 20 | − image smearing |
| 0.30 | 10 | + |
| 0.30 | 50 | + |
| 0.50 | 20 | + |
| 1.00 | 20 | + |
| 0.20 | 10 | − image smearing |
| 0.05 | 60 | − blade chipping |

Also evaluations were made under various values of HU×We. In summary, an image smearing, or a tuck-up, a vibration or a chipping of the cleaning blade was not generated in a range meeting the following relation (1):

$$1/6000\times HU\times We\leqq A\times B \quad (1).$$

This corresponds to a hatched area in FIG. 6, indicating that a larger value of A×B is required for a higher value of HU×We (namely as the photosensitive drum becomes less abradable). This is estimated because the drum surface is not refreshed as it becomes less abradable, thus showing a larger accumulation of the discharge products. Also the contact pressure B (g/cm) of the cleaning blade has to be within a range 10≦B≦50. A contact pressure B of the cleaning blade less than 10 g/cm tends to facilitate a passing-through of the toner, and a contact pressure exceeding 50 g/cm tends to cause a chipping in the cleaning blade.

As regards the contamination of the contact charging roller, the contamination level becomes worse as a value of A/B increases. Stated differently, an increase in the value A/B increases the streak-shaped contamination on the contact charging roller, thus requiring a stronger diffusing ability. Table 3 shows results of an evaluation by a durability test in an environment of a temperature of 23° C. and a humidity of 5% where an unevenness in image is facilitated by contamination on the contact charging roller, under various conditions of an abrasive particle supply amount A, a contact pressure B of the cleaning blade and a crossing angle θ of the contact charging roller. In Table 3, + indicates good and − indicates poor.

TABLE 3

(Image defect by contamination on charging roller)

| A (weight %) | B (g/cm) | θ (°) | Evaluation result |
|---|---|---|---|
| 1.00 | 10 | 0.10 | + |
| 1.00 | 20 | 0.10 | + |
| 2.00 | 10 | 0.20 | + |
| 2.00 | 20 | 0.10 | + |
| 2.00 | 30 | 0.10 | + |
| 2.00 | 10 | 0.10 | − image defect by uneven charging |
| 3.00 | 10 | 0.30 | + |
| 3.00 | 30 | 0.10 | + |
| 3.00 | 20 | 0.10 | − image defect by uneven charging |
| 5.00 | 10 | 0.50 | + |
| 5.00 | 10 | 0.40 | − image defect by uneven charging |
| 5.00 | 20 | 0.30 | + |
| 5.00 | 20 | 0.20 | − image defect by uneven charging |
| 5.00 | 35 | 0.15 | + |
| 7.00 | 20 | 0.40 | + |
| 7.00 | 20 | 0.30 | − image defect by uneven charging |
| 7.00 | 30 | 0.30 | + |
| 10.00 | 30 | 0.40 | + |
| 10.00 | 35 | 0.30 | + |
| 10.00 | 30 | 0.30 | − image defect by uneven charging |

Table 3 shows the results under conditions with relatively large values of A/B, and, in the results under conditions with relatively small values of A/B, the image defect resulting from the contamination on the contact charging roller did not appear within a range of the following condition (II):

$$A/B\leqq\theta \quad (II).$$

Figure 7:
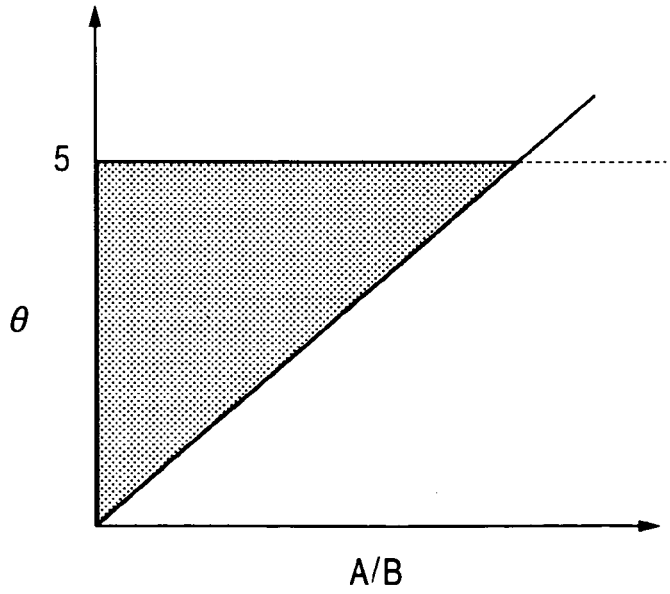
FIG. 7 is a view showing a relationship between θ and A/B in Example 1.

FIG. 7 shows a relationship between A/B and θ, in which a hatched area indicates a range where a satisfactory charging property can be obtained. Under a condition θ>5.00, the charging roller does not contact well at the end portion thereof with the photosensitive member whereby a satisfactory charging property cannot be obtained. Also a crossing angle θ (°) of the rotary axis of the contact charging roller and that of the image bearing member preferably satisfies a condition 0<θ≦5.00, more preferably within a range of 0.10 to 0.50.

In summary of the foregoing results, in the configuration of the present example, a satisfactory cleaning property could be obtained without an image smearing under a high humidity condition or an image unevenness resulting from contamination on the contact charging roller under a low humidity condition, by satisfying the following conditions (I), (II) and (III):

$$1/6000 \times HU \times We \leqq A \times B \quad \text{(I)}$$

$$A/B \leqq \theta \quad \text{(II)}$$

$$10 \leqq B \leqq 50 \quad \text{(III).}$$

Example 2

The present example employed, as the abrasive particle supply method, a method of externally adding the abrasive particles to the developing toner and supplying them under a developing operation. The cleaning apparatus 8 had a structure in Example 1, from which the rotary fur brush 8*d* constituting the abrasive particle supplying member and the abrasive particles 8*j* were removed. Other structures are the same as those in Example 1.

Table 4 shows a relationship between a ratio of the abrasive particles externally added to the toner, and a mixing ratio of the abrasive particles present in the transfer residual (used) toner.

TABLE 4

(Mixing ratio of abrasive particles in transfer residual toner)

| | | | | | | |
|---|---|---|---|---|---|---|
| External addition rate (weight %) of abrasive particles in developing toner | 0.1 | 0.5 | 0.7 | 1.0 | 1.5 | 2.0 |
| Mixing ratio (weight %) of transfer residual toner and abrasive particles = abrasive particle supply amount A | 0.2 | 1.0 | 1.5 | 2.0 | 3.0 | 4.5 |

In the above-described configuration, an image smearing in an environment of a temperature of 30° C. and a humidity of 80%, and a charging unevenness and a cleaning property in an environment of a temperature of 23° C. and a humidity of 5% were evaluated in a durability test of 10,000 prints by varying the abrasive particle supply amount A (weight %) and the contact pressure B (g/cm) of the cleaning blade as in Example 1.

As a result, a satisfactory cleaning property could be obtained without an image smearing under a high humidity condition or an image unevenness resulting from contamination on the contact charging roller under a low humidity condition also in the method of supplying abrasive particles from the developing portion, by satisfying the following conditions (I), (II) and (III):

$$1/6000 \times HU \times We \leqq A \times B \quad \text{(I)}$$

$$A/B \leqq \theta \quad \text{(II)}$$

$$10 \leqq B \leqq 50 \quad \text{(III)}$$

Example 3

The present example employed, as the abrasive particle supply method, both a method of externally adding the abrasive particles to the developing toner and supplying them under a developing operation and a method of providing an abrasive particle supplying member in the developing container. The cleaning apparatus 8 had the same structure as in Example 1. An image smearing in an environment of a temperature of 30° C. and a humidity of 80%, and a charging unevenness and a cleaning property in an environment of a temperature of 23° C. and a humidity of 5% were evaluated in a durability test of 10,000 prints by varying the abrasive particle supply amount A (weight %), the contact pressure B (g/cm) of the cleaning blade and the crossing angle θ.

As a result, a satisfactory cleaning property could be obtained without an image smearing under a high humidity condition or an image unevenness resulting from contamination on the contact charging roller under a low humidity condition by satisfying the following conditions (I), (II) and (III):

$$1/6000 \times HU \times We \leqq A \times B \quad \text{(I)}$$

$$A/B \leqq \theta \quad \text{(II)}$$

$$10 \leqq B \leqq 50 \quad \text{(III).}$$

By having two or more abrasive particle supplying means as in the present example, a more stable supply of the abrasive particles can be realized throughout the durability test.

This application claims priority from Japanese Patent Application Nos. 2004-144334 filed May 14, 2004, and 2005-069543 filed Mar. 11, 2005, which are hereby incorporated by reference herein.

What is claimed is:

1. An image forming method comprising:

a charging step of charging an image bearing member with a charging member;

an electrostatic latent image forming step of forming an electrostatic charge image on the image bearing member thus charged;

a developing step of developing the electrostatic charge image with a toner thereby forming a toner image;

a transfer step of transferring the toner image, formed on the image bearing member, onto a recording medium either using or without using an intermediate transfer a member;

a fixing step of heat fixing the toner image onto the recording medium; and a cleaning step of cleaning a surface of the image bearing member after the image transfer with a cleaning member, wherein the image bearing member has a universal surface hardness HU of 150 to 220 N/mm$^2$ and an elastic deformation ratio We of 40 to 65%, as measured in a hardness test employing a tetragonal cone diamond indenter pressed under a maximum load of 6 mN in an environment of a temperature of 25° C. and a humidity of 50%, wherein the charging member is a contacting charging roller so provided as to be brought into contact with the image bearing member, that a rotary axis of the contact charging roller and a rotary axis of the image bearing member mutually cross with a crossing angle θ(°), wherein the cleaning member is a cleaning blade so provided as to be brought into contact with the image bearing member, wherein abrasive particles are present in a contact portion between the cleaning blade and the image bearing member, and wherein for a ratio A (% by weight) of the transfer residual toner reaching the cleaning blade and the abrasive particles and for a contact pressure B (g/cm) of the cleaning blade, HU, We, A, B, and θ satisfy the following relations (I), (II) and (III):

$$(1/6000)\times HU\times We \leqq A\times B \quad \text{(I)}$$

$$A/B\times\theta \quad \text{(II)}$$

$$10 \leqq B \leqq 50 \quad \text{(III)}.$$

2. An image forming method according to claim 1, wherein the abrasive particles are inorganic fine particles selected from the group consisting of strontium titanate, calcium titanate and barium titanate.

3. An image forming method according to claim 1, wherein the abrasive particles have an average primary particle size of 30 to 300 nm, a cubic and/or rectangular parallelepiped particulate shape, a perovskite crystalline structure, and a content of particles and agglomerates having a particle size of 600 nm or larger, equal to or less 1% by number.

4. An image forming method according to claim 1, wherein the abrasive particles are supplied by an abrasive particle supply member in a cleaning container.

5. An image forming method according to claim 4, wherein the abrasive particle supply member in the cleaning container is a rotatable fur brush.

6. An image forming method according to claim 1, wherein the abrasive particles are externally added to toner particles and are supplied in a developing operation.

7. An image forming method according to claim 1, wherein the cleaning blade is a rubber blade.

8. An image forming method according to claim 1, wherein a contact pressure of the contact charging roller to the image bearing member is 50 g/cm or less.

9. An image forming method according to claim 1, wherein the contact charging roller has an Asker C hardness of 20 to 60°.

10. An image forming method according to claim 1, wherein the image bearing member is a photosensitive member comprising a substrate and a photosensitive layer formed on the substrate.

* * * * *

UNITED STATES PATENT AND TRADEMARK OFFICE

CERTIFICATE OF CORRECTION

PATENT NO. : 7,272,344 B2
APPLICATION NO. : 11/128365
DATED : September 18, 2007
INVENTOR(S) : Masaharu Miura et al.

It is certified that error appears in the above-identified patent and that said Letters Patent is hereby corrected as shown below:

ON THE TITLE PAGE:

At Item (56), References Cited, OTHER PUBLICATIONS, "Patent Abstracts of Japan, Publication No. 2002364633A, Dec. 18, 2002" should read --Patent Abstracts of Japan, Publication No. 2002-364633A, Dec. 18, 2002--.

At Item (57), ABSTRACT, Line 5, "with a" should read --with an--; and

Line 19, "$10 \leq B \leq 50$. (III)" should read --$10 \leq B \leq 50$ (III).--.

COLUMN 3:

Line 18, "a" should read --an--; and

Line 25, "a" should read --an--.

COLUMN 4:

Line 5, "a" should read --an--.

COLUMN 35:

Line 65, (examples of compound, No. 92), "$OCH_3$" should read --$OCH_2$--.

COLUMN 45:

Line 65, "dibenzpyrene" should read --dibenzopyrene--.

COLUMN 47:

Line 38, "has" should read --have--.

COLUMN 49:

Line 18, "an" should read --a--.

COLUMN 54:

Line 47, "particles 41 of" should read --particles of--; and

Line 51, "ticles 42 enter" should read --ticles enter--.

COLUMN 56:

Line 61, "particles $\mathbf{8}_j$ be" should read --particles $\mathbf{8}_j$ may be--.

COLUMN 58:

Line 44, "an" should read --a--.

UNITED STATES PATENT AND TRADEMARK OFFICE

CERTIFICATE OF CORRECTION

PATENT NO. : 7,272,344 B2
APPLICATION NO. : 11/128365
DATED : September 18, 2007
INVENTOR(S) : Masaharu Miura et al.

It is certified that error appears in the above-identified patent and that said Letters Patent is hereby corrected as shown below:

COLUMN 64:

Line 41, "a" should be deleted; and
Line 55, "contacting" should read --contact--.

Signed and Sealed this

Twenty-seventh Day of May, 2008

JON W. DUDAS
*Director of the United States Patent and Trademark Office*